US007789472B2

(12) United States Patent
Richardson et al.

(10) Patent No.: US 7,789,472 B2
(45) Date of Patent: Sep. 7, 2010

(54) MODULAR COLOR PALLET DISPLAY SYSTEM

(75) Inventors: Joseph T. Richardson, Irvine, CA (US); Mary Rose Rice, Laguna Niguel, CA (US)

(73) Assignee: Behr Process Corporation, Santa Ana, CA (US)

( * ) Notice: Subject to any disclaimer, the term of this patent is extended or adjusted under 35 U.S.C. 154(b) by 800 days.

(21) Appl. No.: 10/702,907

(22) Filed: Nov. 5, 2003

(65) Prior Publication Data

US 2005/0102918 A1 May 19, 2005

(51) Int. Cl.
*A47G 29/00* (2006.01)

(52) U.S. Cl. ..... 312/265.3

(58) Field of Classification Search ..... 312/114, 312/140, 140.1, 140.4, 198, 195, 196, 223.6; 211/189, 26, 26.2; 52/36.1
See application file for complete search history.

(56) References Cited

U.S. PATENT DOCUMENTS

| | | | | |
|---|---|---|---|---|
| 1,381,501 | A | 6/1921 | Reigersberg | |
| 1,678,522 | A | 7/1928 | Murdoch | |
| 2,206,353 | A | 7/1940 | Hill | |
| 2,328,130 | A * | 8/1943 | Earie | 62/77 |
| 2,999,599 | A | 9/1961 | Jentzen | |
| 3,125,385 | A | 3/1964 | Friedman | |
| 3,316,041 | A | 4/1967 | Nelson | |
| 3,675,955 | A * | 7/1972 | Hajduk | 217/65 |
| 3,749,465 | A * | 7/1973 | Newcomer | 312/245 |
| 3,971,605 | A * | 7/1976 | Sasnett | 312/198 |
| 3,980,361 | A | 9/1976 | Shaw et al. | |
| 4,008,931 | A * | 2/1977 | Kennedy et al. | 312/111 |
| 4,116,509 | A | 9/1978 | Smith | |
| 4,148,535 | A | 4/1979 | Fenwick | |
| 4,162,113 | A | 7/1979 | Pallavicini | |
| 4,371,221 | A * | 2/1983 | Citterio | 312/199 |
| 4,384,751 | A * | 5/1983 | Guntermann et al. | 312/265.4 |
| 4,419,938 | A * | 12/1983 | Kaut | 108/190 |
| 4,567,698 | A * | 2/1986 | Morrison | 52/36.6 |
| 4,586,759 | A * | 5/1986 | Wrobel | 312/198 |
| 4,699,270 | A * | 10/1987 | Bohm | 312/107 |
| 4,821,477 | A * | 4/1989 | Rydqvist | 52/239 |
| 4,938,548 | A * | 7/1990 | Richardson | 312/233 |
| 4,948,203 | A * | 8/1990 | Amstutz et al. | 312/140 |
| 5,199,775 | A * | 4/1993 | Morgan et al. | 312/257.1 |
| 5,405,192 | A | 4/1995 | McGrath | |
| 5,439,123 | A * | 8/1995 | Nook | 211/187 |

(Continued)

FOREIGN PATENT DOCUMENTS

| | | |
|---|---|---|
| CH | 560 029 A5 | 3/1975 |

(Continued)

*Primary Examiner*—Janet M Wilkens
*Assistant Examiner*—Matthew W Ing
(74) *Attorney, Agent, or Firm*—Greenberg Traurig LLP; Franklin D. Ubell

(57) ABSTRACT

A modular color display system with interchangeable components and modules which permit assembling the display system in a plurality of configurations using the same components. Such configuration reduces the cost of assembling and manufacturing by minimizing the number non-interchangeable parts in the display system. Lifting points in an upper portion of the display assembly permit assembling an upper portion joining a plurality of frames and lifting them using a forklift. Another aspect of the invention provides a paint selection kiosk as part to the display assembly.

31 Claims, 24 Drawing Sheets

U.S. PATENT DOCUMENTS

| | | | | | |
|---|---|---|---|---|---|
| 5,628,415 | A | * | 5/1997 | Mulholland | 211/189 |
| 5,647,648 | A | * | 7/1997 | Duesler | 312/108 |
| 5,961,192 | A | * | 10/1999 | Bernart et al. | 312/223.3 |
| 6,095,482 | A | * | 8/2000 | LaGrotta et al. | 248/672 |
| 6,196,648 | B1 | * | 3/2001 | Henriott | 312/196 |
| 6,267,462 | B1 | | 7/2001 | Krause et al. | |
| 6,273,531 | B1 | * | 8/2001 | Scheffer | 312/196 |
| D449,077 | S | * | 10/2001 | Bain et al. | D20/10 |
| 6,467,856 | B1 | | 10/2002 | Chang et al. | |
| 6,533,372 | B1 | * | 3/2003 | McCrossin et al. | 312/140.4 |
| 6,560,093 | B1 | * | 5/2003 | McLeod et al. | 361/681 |
| 6,659,295 | B1 | | 12/2003 | De Land et al. | |
| 2002/0108330 | A1 | * | 8/2002 | Yu et al. | 52/238.1 |
| 2002/0170240 | A1 | * | 11/2002 | Thompson | 52/36.1 |
| 2003/0090176 | A1 | * | 5/2003 | Bartholomew et al. | 312/35 |
| 2004/0060884 | A1 | * | 4/2004 | Nook et al. | 211/189 |

FOREIGN PATENT DOCUMENTS

| | | | | |
|---|---|---|---|---|
| DE | 25 46 796 | A1 | | 4/1977 |
| DE | 298 03 156 | U1 | | 8/1998 |
| DE | 201 00 825 | U1 | | 5/2001 |
| DE | 202 03 068 | U1 | | 6/2002 |
| JP | 9121965 | | * | 5/1997 |

* cited by examiner

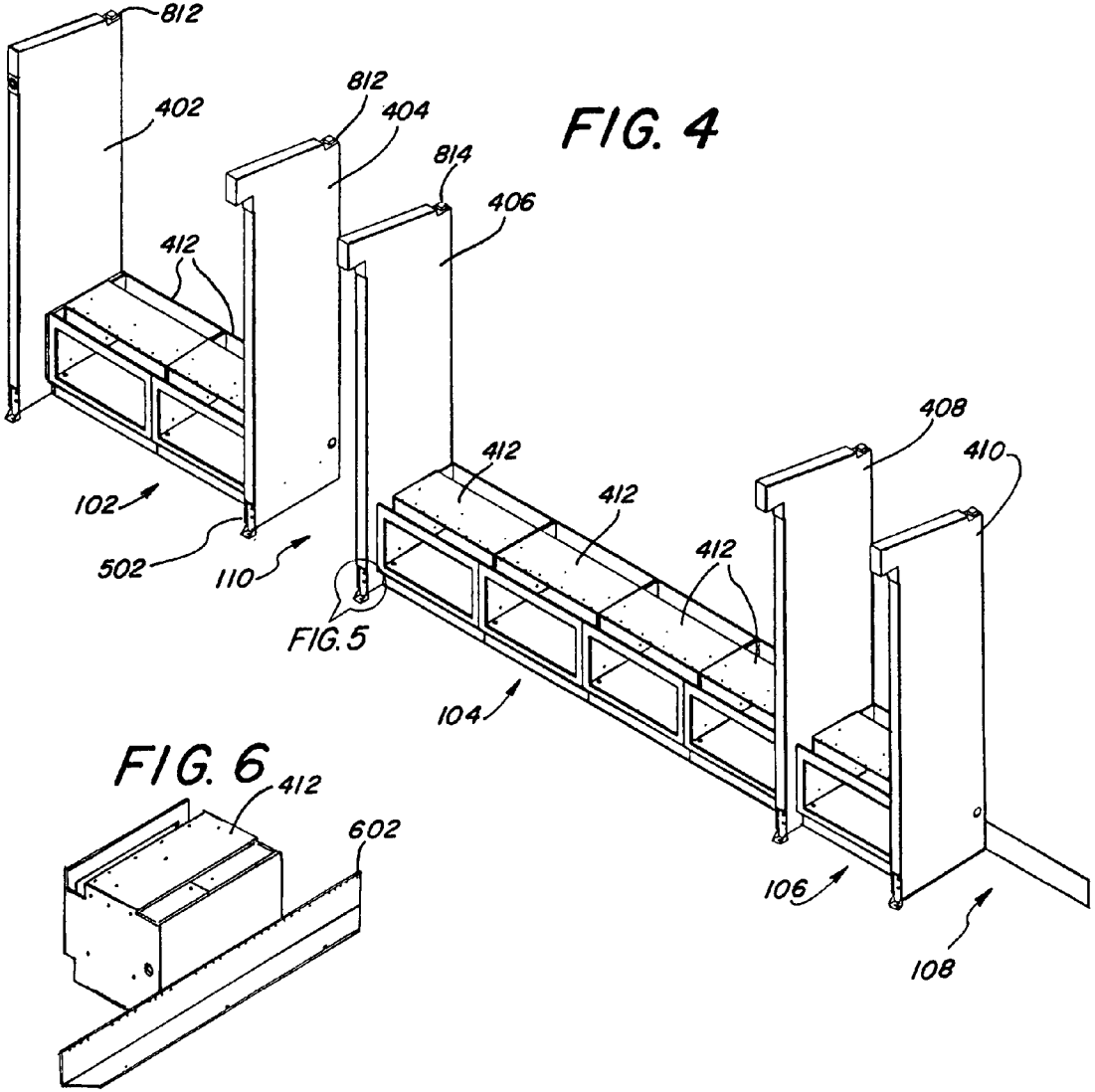
FIG. 4
FIG. 6
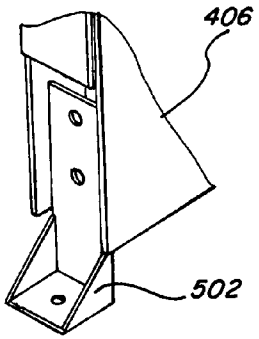
FIG. 5

MODULAR COLOR PALLET DISPLAY SYSTEM

FIELD OF THE INVENTION

Various embodiments of the invention pertain to cabinet display assemblies. More particularly, at least one embodiment of the invention relates a modular display system for paint colors and advertising.

DESCRIPTION OF RELATED ART

When designing a display unit, such as a display cabinet, for retail environments, it is often necessary to deploy the same display assembly in different retail locations and in various configurations. The need for varying cabinet configurations often requires that several versions of the display assemblies be manufactured and warehoused, increasing the cost of deployment. Additionally, installation of such different display assemblies requires identifying the particular display assembly to be used at each location, ordering the appropriate display assembly for each location, and training personnel to assembly each type of display assembly.

In assembling such display cabinet assemblies, it is often necessary to position advertising panels along the upper regions of the display assemblies. Assembly and positioning such advertising panels often requires the manual lifting of heavy and/or large components. Thus, the addition of advertising panels to the display assemblies adds complexity and time to the assembly of the overall display assemblies.

BRIEF DESCRIPTION OF THE DRAWINGS

FIG. 4 illustrates how the modular display system found in FIG. 1 may be constructed according to one embodiment of the invention.

FIG. 5 illustrates how one or more brackets may be fastened to the side walls and serve to anchor the side walls to the floor or supporting surface according to one embodiment of the invention.

FIG. 6 illustrates how a bracket may be coupled to the back portion of one or more cabinets and to the floor secure the display system according to one embodiment of the invention.

DETAILED DESCRIPTION

In the following description numerous specific details are set forth in order to provide a thorough understanding of the invention. However, one skilled in the art would recognize that the invention may be practiced without these specific details. In other instances, well known methods, procedures, and/or components have not been described in detail so as not to unnecessarily obscure aspects of the invention.

In the following description, certain terminology is used to describe certain features of one or more embodiments of the invention. For instance, "display assembly" includes any cabinet, counter, advertising panels, etc., and combination thereof.

While various embodiments of the invention relate to a modular display assembly for displaying paint color samples, the present invention is to be interpreted broadly to cover any modular display assembly, method of assembling, and manufacturing of modular display assemblies.

One aspect of the present invention provides a modular color display system with interchangeable components and modules which permit assembling the display system in a plurality of configurations using the same components. Such configuration reduces the cost of assembling and manufacturing by minimizing the number non-interchangeable parts in the display system. Additionally, lifting points are included in the upper portions of the display assembly to permit assembling and lifting the joined upper portions using a forklift. Another aspect of the invention includes a paint selection kiosk as part to the display assembly.

Figure 1:
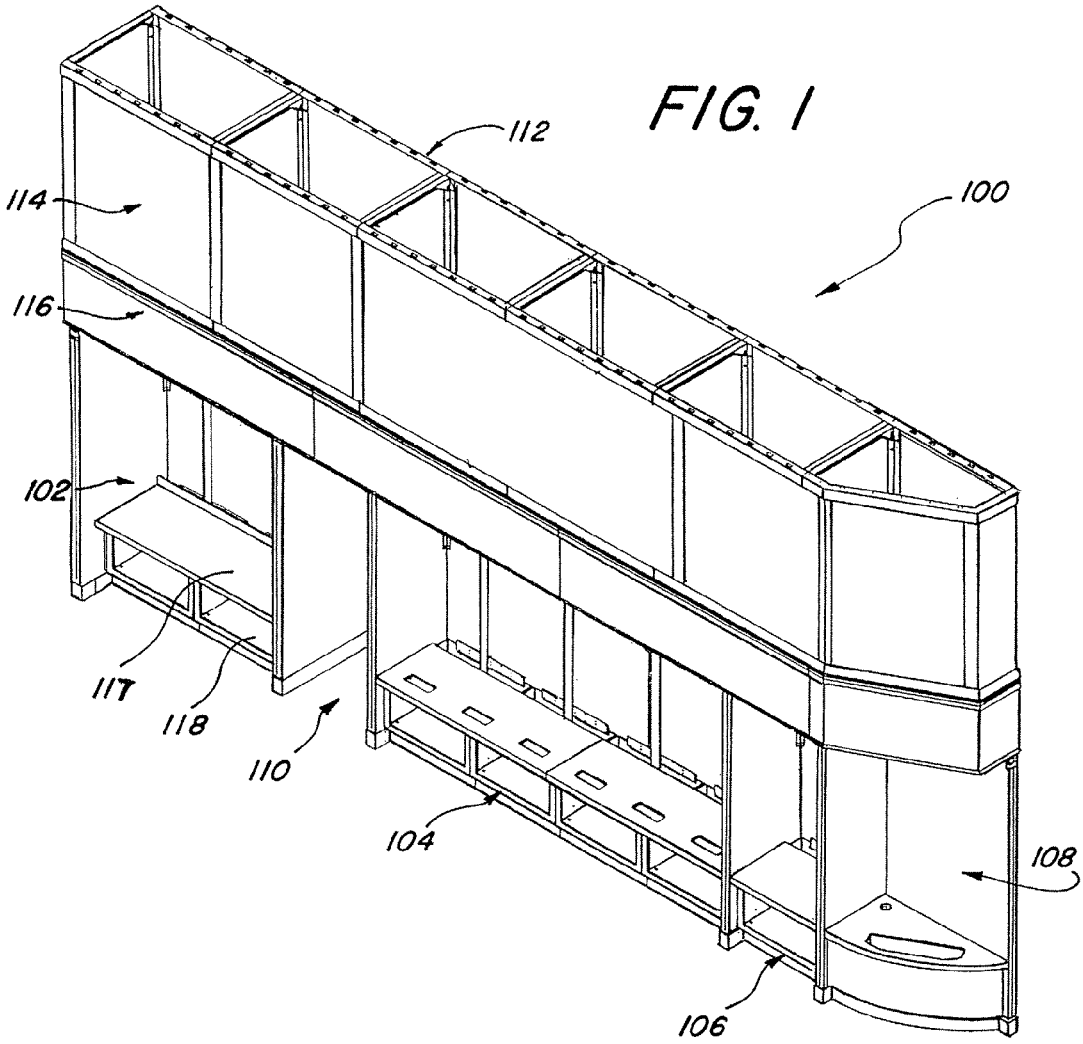
FIG. 1 illustrates a front-side perspective view of the color coordination kiosk cabinet according to one embodiment of an aspect of the invention.

FIG. 1 illustrates one embodiment of a color pallet display system according to one implementation of the invention. The display system 100 includes a plurality of side-by-side display sections 102, 104, 106, and 108. The display sections may serve as areas where various paint color samples and/or literature may be displayed. The display system 100 also includes an area 10 where a color selection kiosk may be placed.

The display system may also include an upper structure 112 supported by the side walls of lower display areas 102, 104, 106 and 108. The upper structure 112 may serve to support display panels 114 for advertising and/or other purposes. Additionally, the upper structure 112 may also include a section 116 where brand headers may be placed. The display areas 102, 104, 106 and 108 may also include counter surfaces 117 and cabinets 118.

Figure 2:
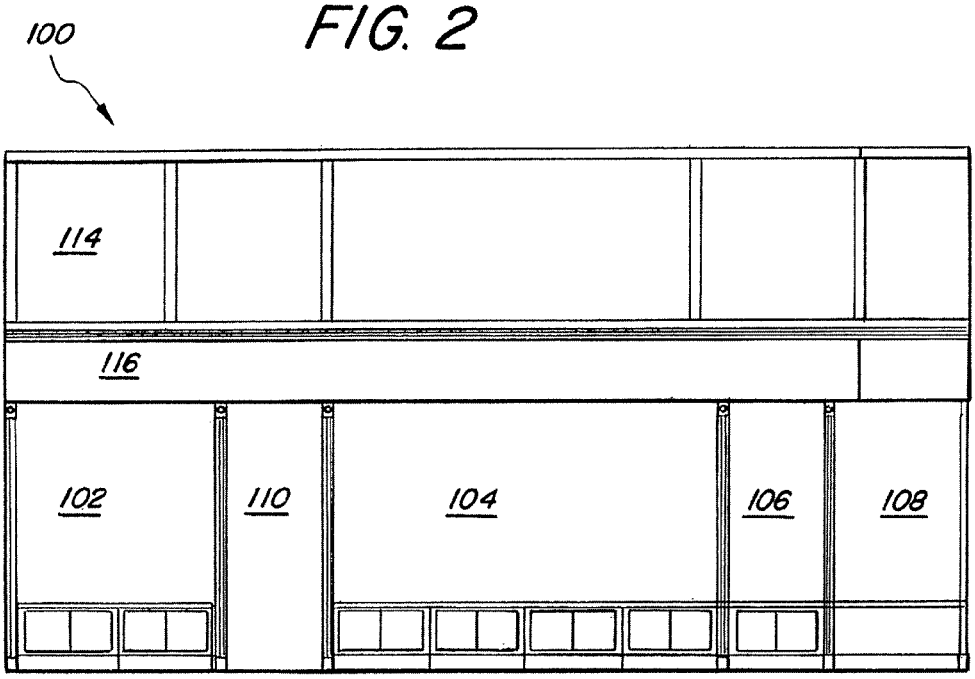
FIG. 2 illustrates a front view of the modular color palette display system illustrated in FIG. 1 according to one embodiment of the invention.

FIG. 2 illustrates a front view of the modular color palette display system 100 illustrated in FIG. 1 according to one embodiment of the invention. This configuration of the display assembly shows a rounded end-section 108 on the left end of the display assembly 100.

Figure 3:
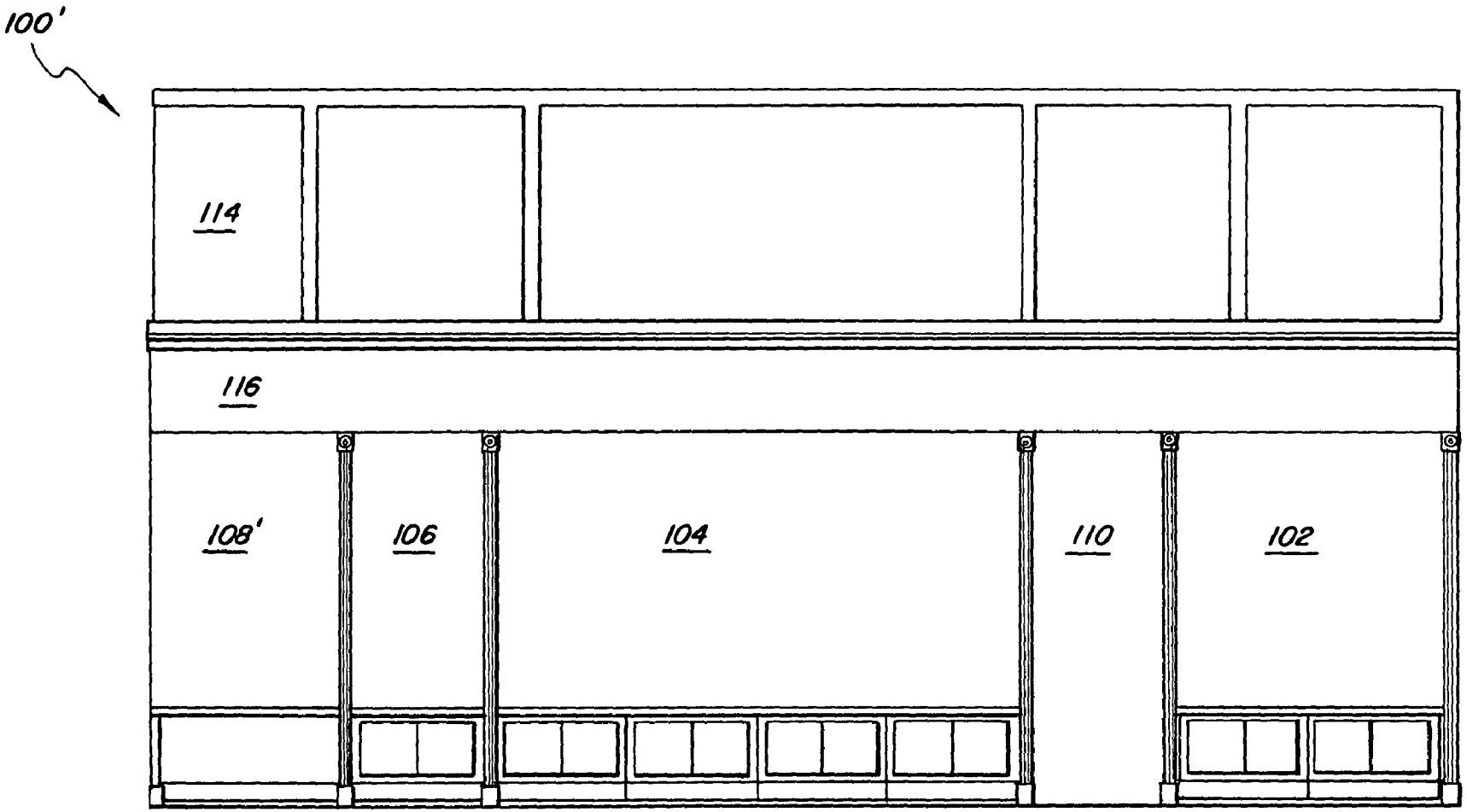
FIG. 3 illustrates another color palette modular display system according to one embodiment of the invention.

FIG. 3 illustrates a different embodiment of a color palette modular display system according to one embodiment of the invention. In this embodiment, the modules 102, 104, 106, 108, and 110 have been rearranged so that the rounded end-section 108' is at the right end of the display assembly 100'. It is to be understood that the display modules 102, 104, 106, and 108 and the kiosk area 110 may be interchangeable and/or rearranged in different positions without departing from the invention.

FIG. 4 illustrates how the modular display system 100 found in FIG. 1 may be constructed according to one embodiment of the invention. A plurality of interchangeable side walls 402, 404, 406, 408, 410 serve to define the various display areas 102, 104, 106, 108, and 110. According to one embodiment of the display system 100, a plurality of cabinets 412 may be joined together to serve as the base as support for the various side walls 402, 404, 406, 408, and 410.

As illustrated in FIG. 5, one or more brackets 502 may be fastened to the side walls 402, 404, 406, 408, and 410 and serve to anchor the side walls to the floor or supporting surface according to one embodiment of the invention. Installation of the side walls and cabinet system may involve drilling holes onto the floor or supporting surface so that a fastener may be passed through the bracket and coupled to the floor.

FIG. 6 illustrates how a bracket 602 may be coupled to the back portion of one or more cabinets 412 and to the floor secure the display system 100 according to one embodiment of the invention.

Figure 7:
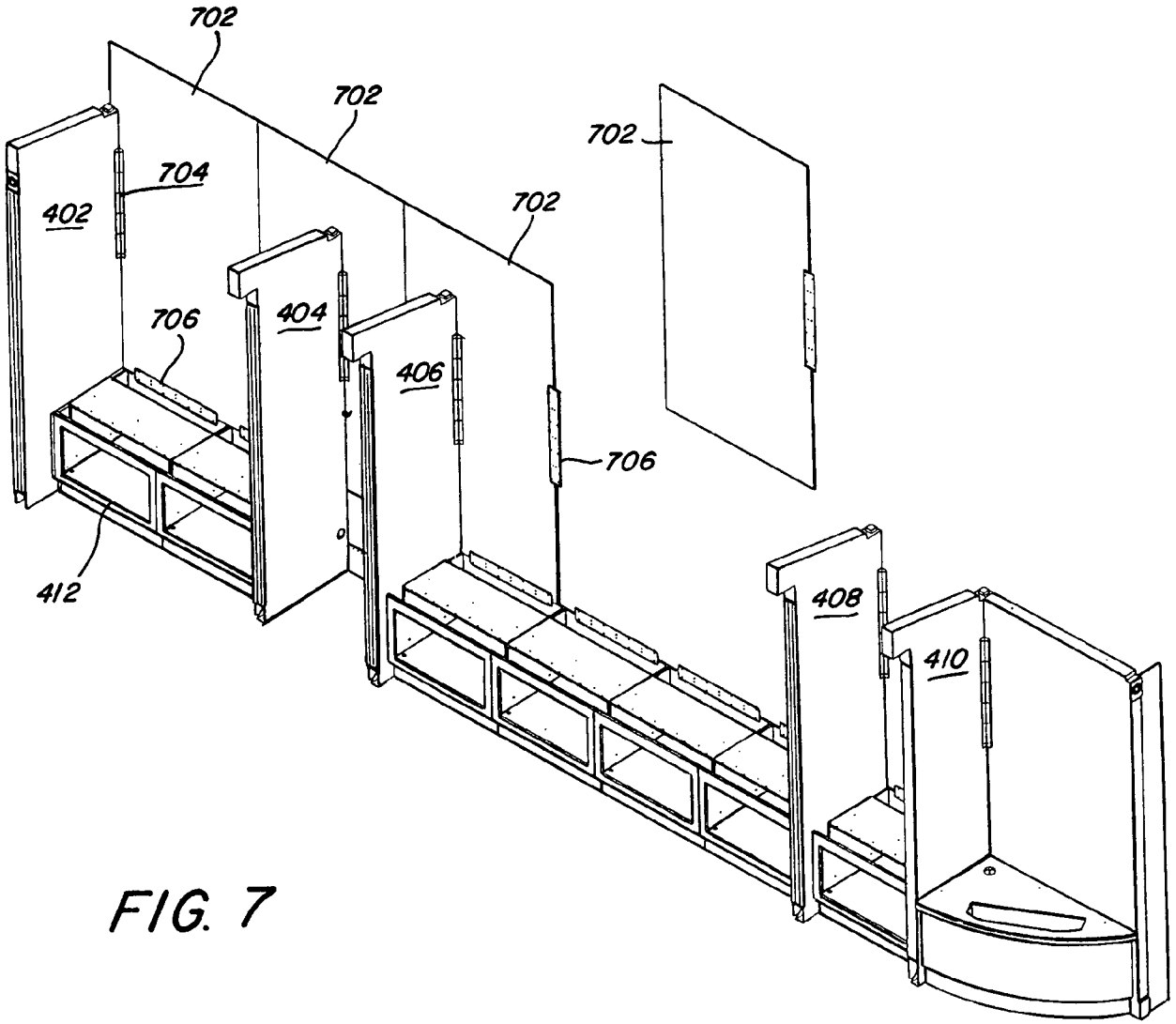
FIG. 7 illustrates how a plurality of back panels may be coupled along the back portion of the modular display system according to one embodiment of the invention.

FIG. 7 illustrates how a plurality of back panels 702 may be coupled along the back portion of the modular display system according to one embodiment of the invention. A plurality of angle brackets 704 serve to couple the back panels 702 to the side walls 402, 404, 406, 408, 410. Flat braces 706 serve to couple the back panels 702 to the back portions of the cabinets 412 and to other back panels.

Figure 8:
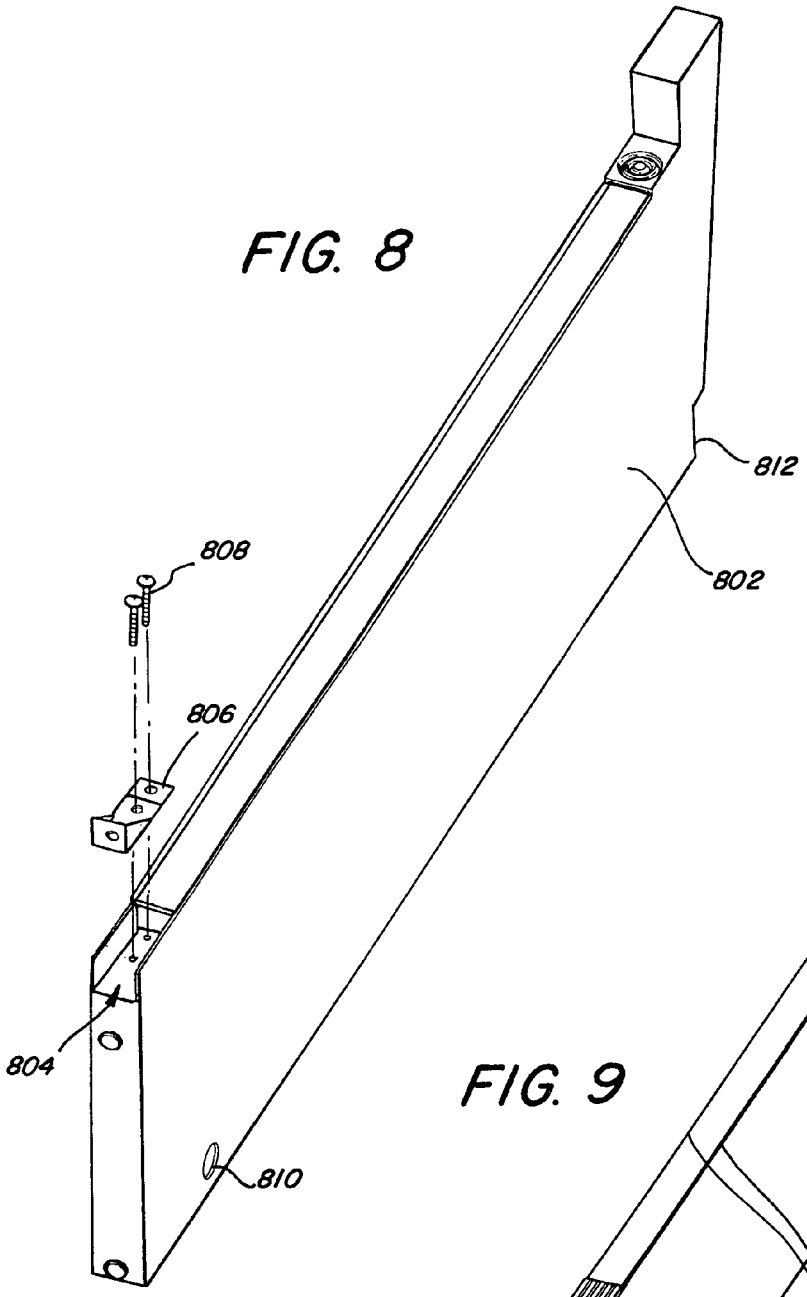
FIGS. 8-10 illustrate an embodiment of a side wall of the modular display system according to one embodiment of the invention.

FIG. 8 illustrates an embodiment of a side wall 802 (e.g., 402, 404, 406, 408, 410) with a recessed portion 804 along the lower portion of the front bottom portion of the wall 802 according to one embodiment of the invention. This recessed portion 804 serves to receive a mounting bracket 806. The bracket may be fastened to the wall 802 with one or more fasteners 808. When installing the wall 802, the bracket 806 may be attached to the floor or surface on which the wall is supported with one or more fasteners. The wall 802 may also include an opening 810 near the lower back edge of the wall 802 through which electrical cable may be passed. The wall 802 may also have a notched region 812 which serves to receive and support an upper display region. The notched region may include a protrusion 814 (FIG. 4) which helps to secure the upper display region.

Figure 9:
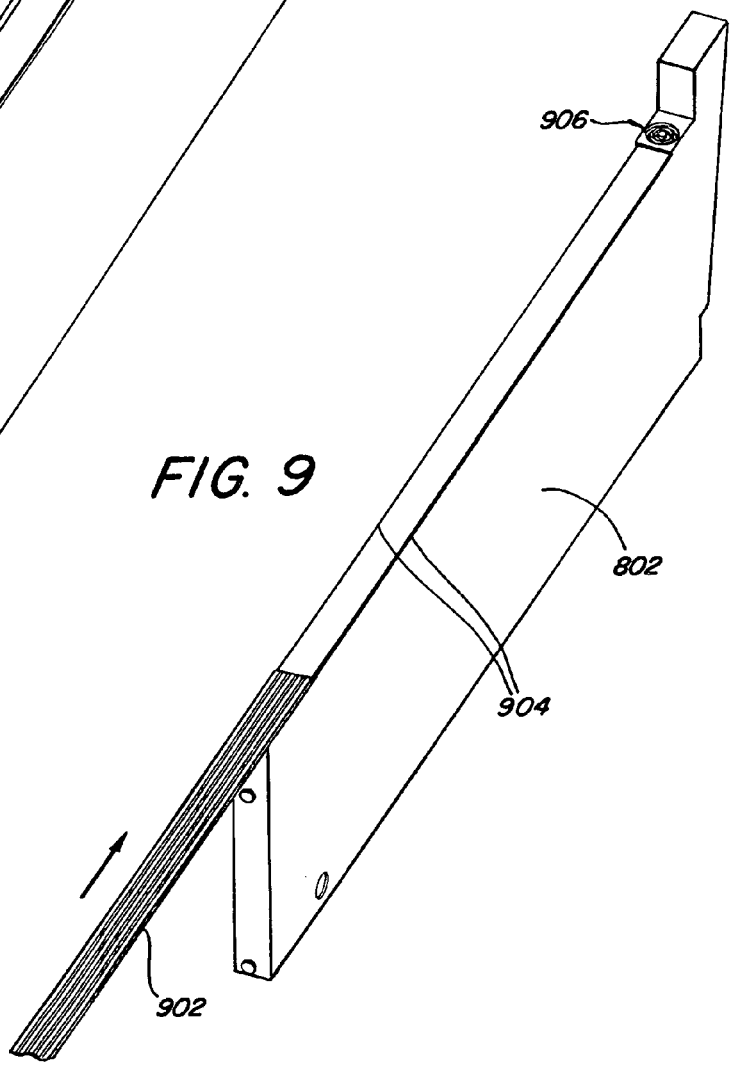
Figure 10:
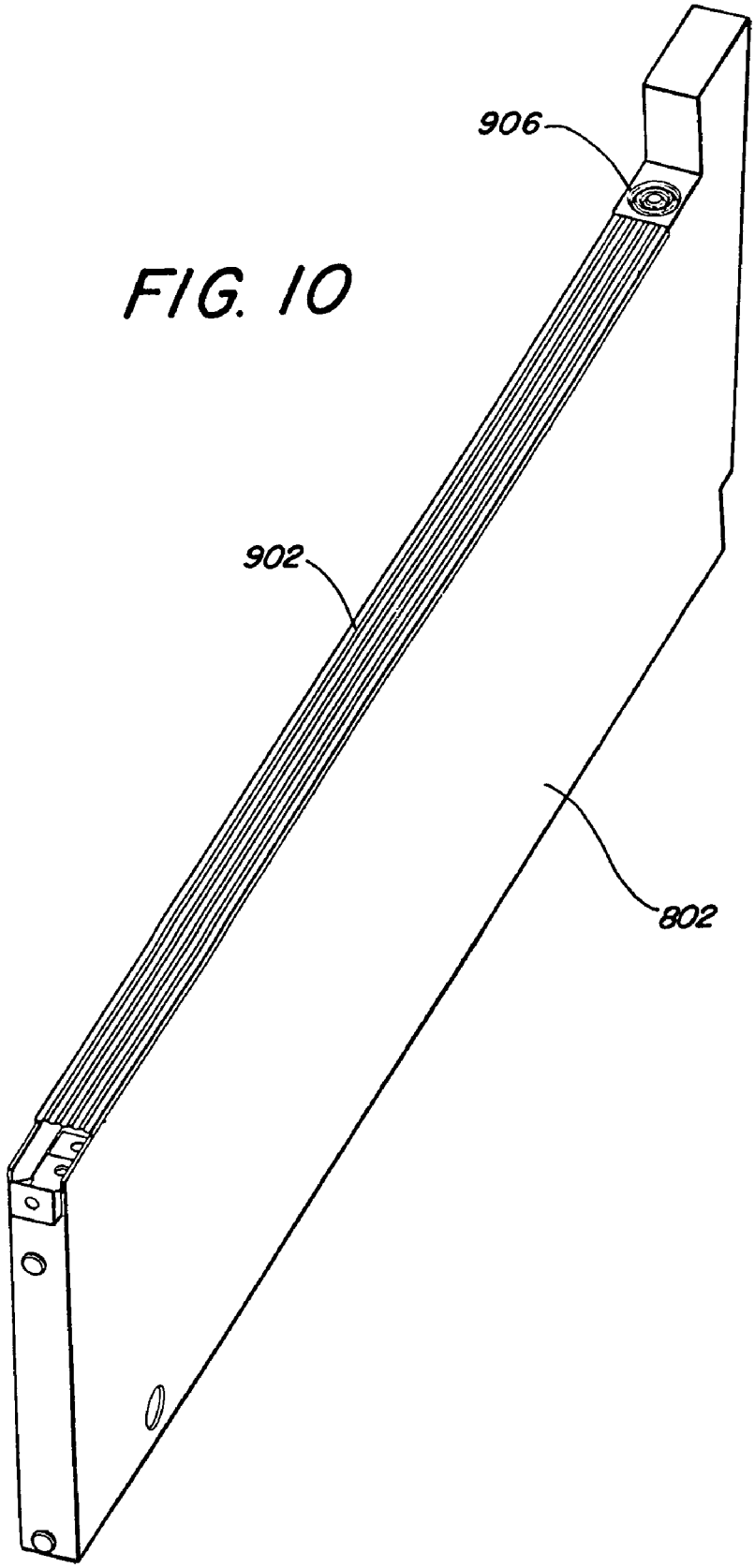

FIG. 9 illustrates how a wood detail edge 902 may be slideably engaged to the front edge of the wall 802 according to one embodiment of the invention. The detail edge 902 is slid up, along side grooves 904 on the front edge of the wall 802, until it reaches the top of the front edge and is flush with the bottom of the Rosetta detail 906 as illustrated in FIG. 10.

Figure 11:
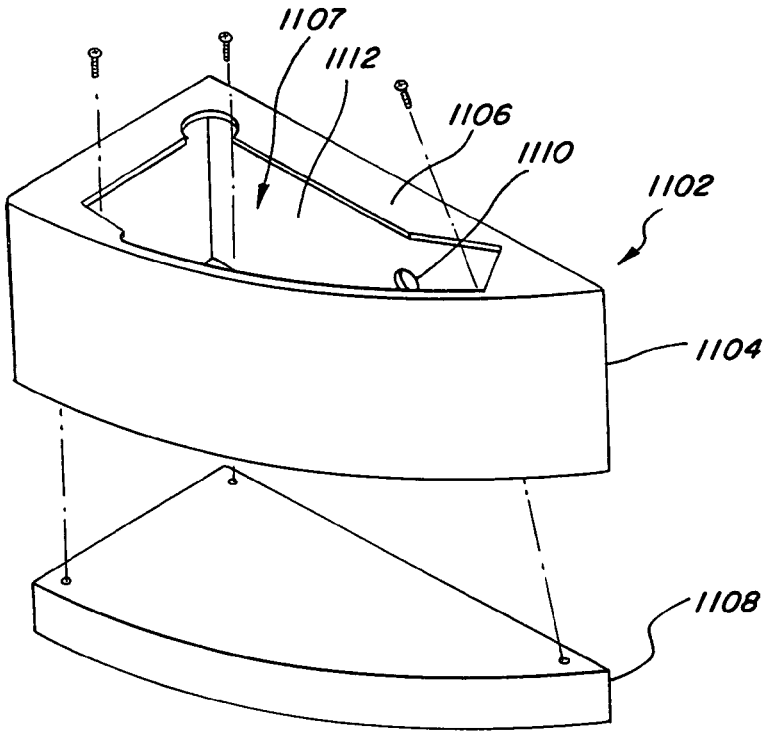
FIG. 11 illustrates how a curved cabinet may be constructed according to one embodiment of the invention.

FIG. 11 illustrates how a curved cabinet 1102 may be constructed according to one embodiment of the invention. The curved cabinet 1102 includes a curved enclosure 1104 which is fastened to a base section 1108 and a top surface 1106. The top surface 1106 includes an opening 1107 to permit mounting of a holder 1206. The back surface 1112 of the curved enclosure 1104 may also include an opening 1110 for passing electrical conduit.

Figure 12:
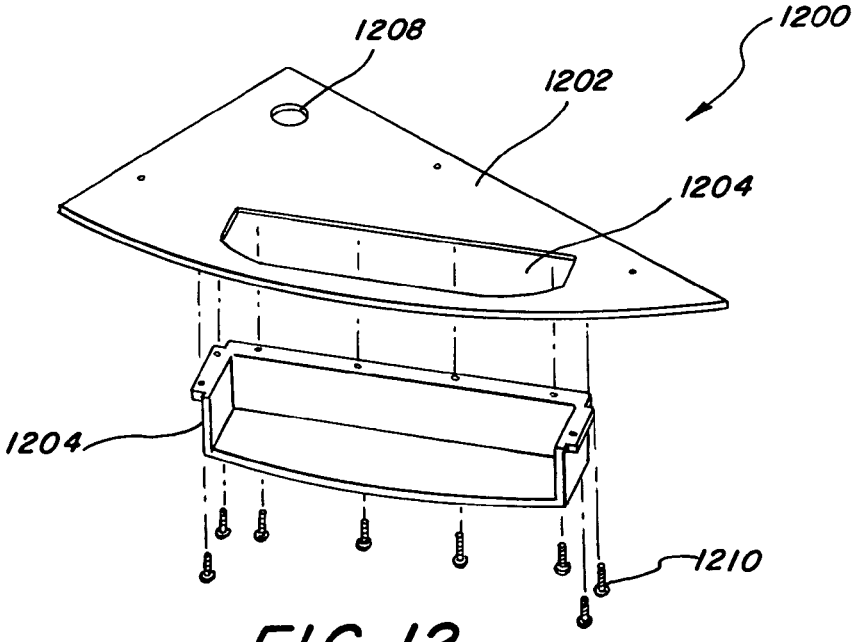
FIG. 12 illustrates a countertop assembly including a cover surface with an opening and a holder on which display information may be inserted according to one embodiment of the invention.

FIG. 12 illustrates a cover assembly 1200 including a cover surface 1202 with an opening 1204 and a holder 1206 on which display information (e.g., brochures, leaflets, booklets, etc.) may be inserted according to one embodiment of the invention. In one embodiment of the invention, the holder 1206 is fastened to the underside of the cover surface 1202 using one or more fasteners 1210. This cover assembly 1200 is placed over the top surface 1106 of the curved cabinet 1102 and fastened. The top surface 1202 of the cover assembly 1200 may also include an opening 1208 through which electrical conduit may pass.

Figure 13:
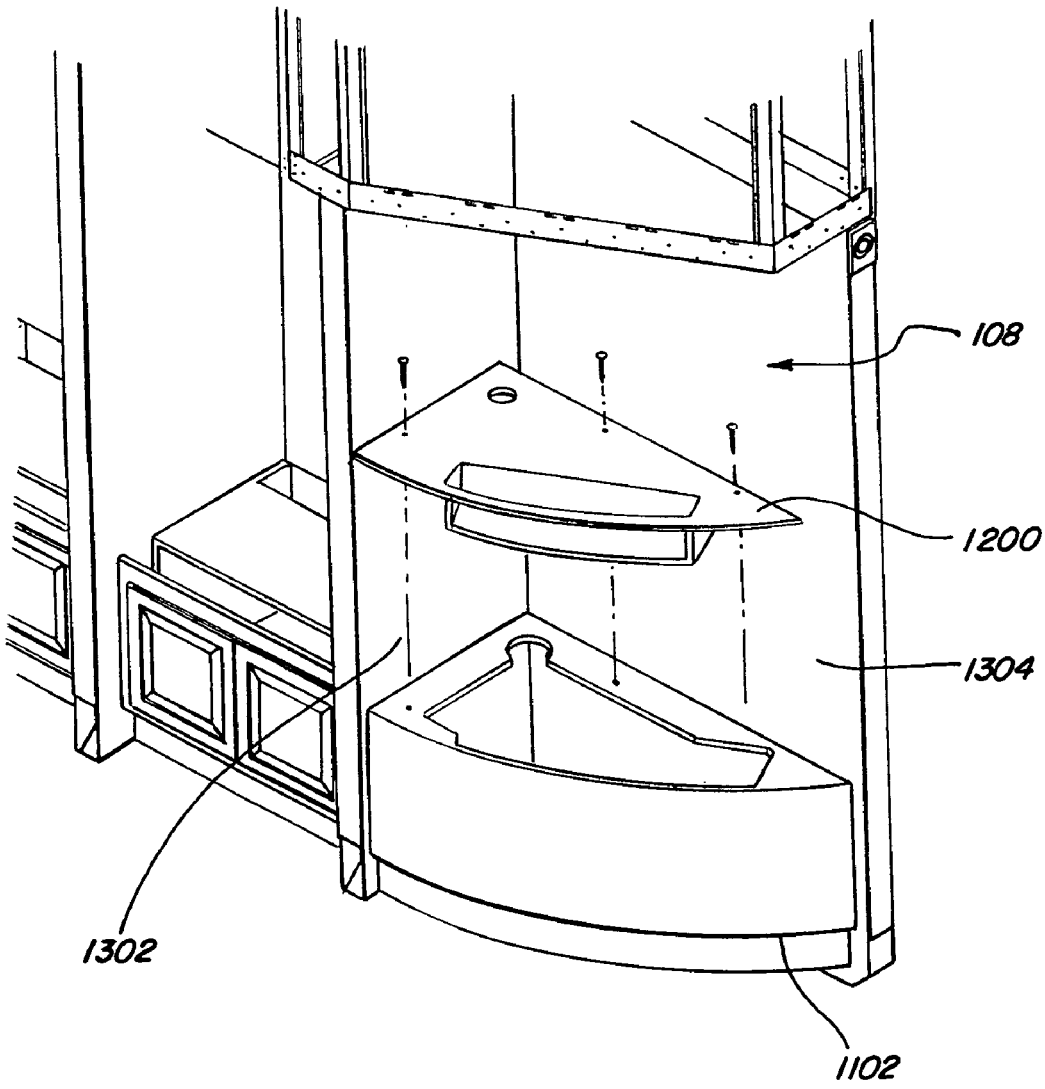
FIG. 13 illustrates how an end display section may receive the curved cabinet on which the countertop assembly of FIG. 12 may be placed according to one embodiment of the invention.

FIG. 13 illustrates how the end display section 108 may receive the curved cabinet 1102 on which surface 1200 may be placed with fasteners according to one embodiment of the invention. The curved cabinet 1102 is placed along the bottom of a side wall 1302 and a back wall or panel 1304 in the display system 100.

Figure 14:
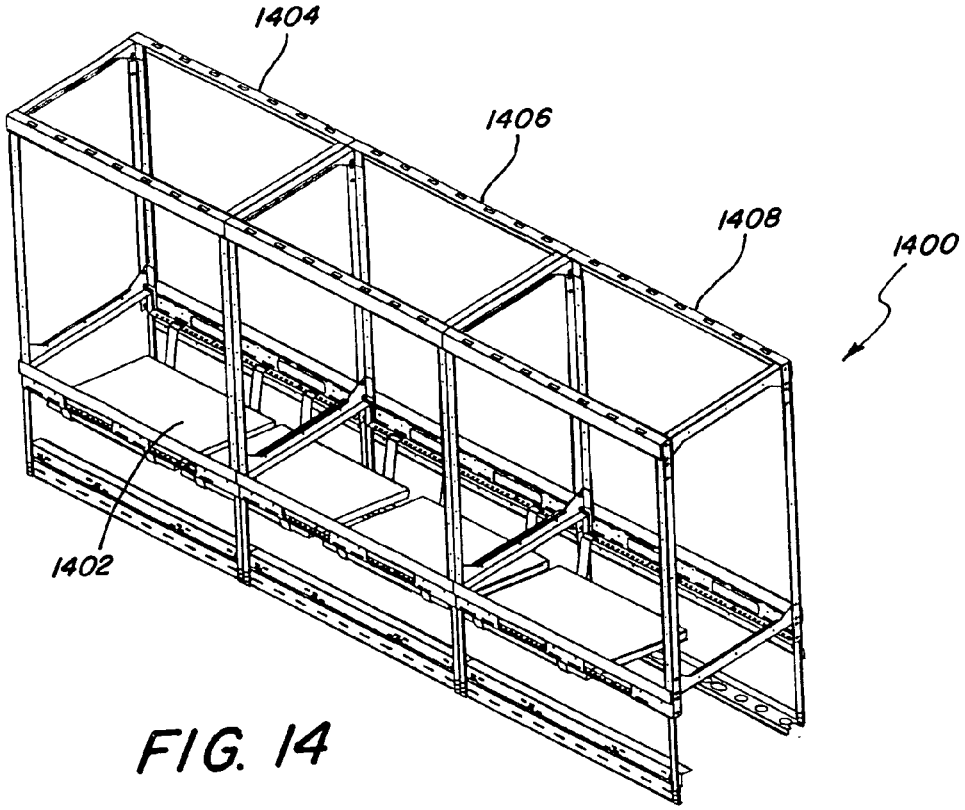
FIG. 14 illustrates an upper frame combination including three frame modules that have been coupled together according to one embodiment of the invention.
Figure 15:
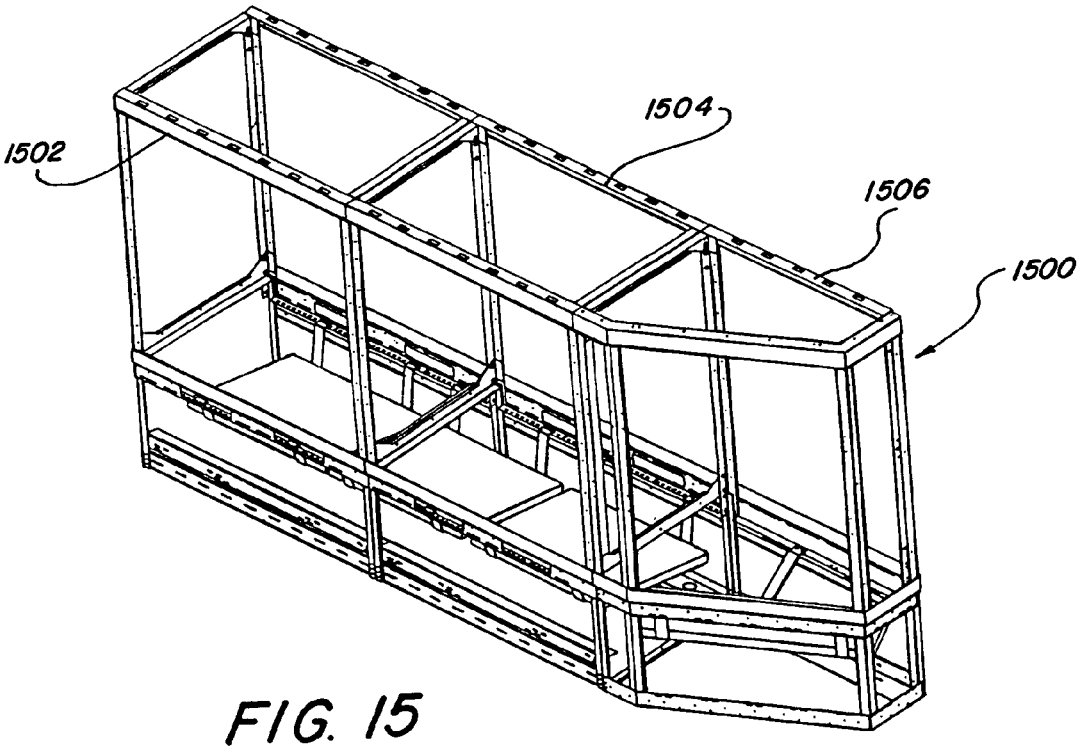
FIG. 15 illustrates another upper frame combination of three frame modules that have been coupled together according to one embodiment of the invention.

FIGS. 14 and 15 illustrate an embodiment of an upper structure 112 (FIG. 1) including a plurality of upper frame combinations 1400 and 1500 that may be placed on top of the display sections 102, 104, 106, 108 and 110 according to one embodiment of the invention.

FIG. 14 illustrates an upper frame combination 1400 including three frame modules 1404, 1406, 1408 that have been coupled together according to one embodiment of the invention. A plurality of light-supporting surfaces 1402 are attached along the lower portion of the frame modules 140 to the frames 1404, 1406, 1408. The light-supporting surfaces 1402 may serve to mount lights which help illuminate the lower modules 102, 104, 106, 108 and 110, and/or the signs mounted along the front of the upper structure 112.

FIG. 15 similarly illustrates a combination of three frame modules that have been coupled together according to one embodiment of the invention. Frame modules 1502 and 1504 may be similar to the frame modules illustrated in FIG. 14. Frame module 1506 corresponds to the end section 108. Said end frame module 1506 is used to match the curved cabinet along one end of the display module 100.

Figure 16:
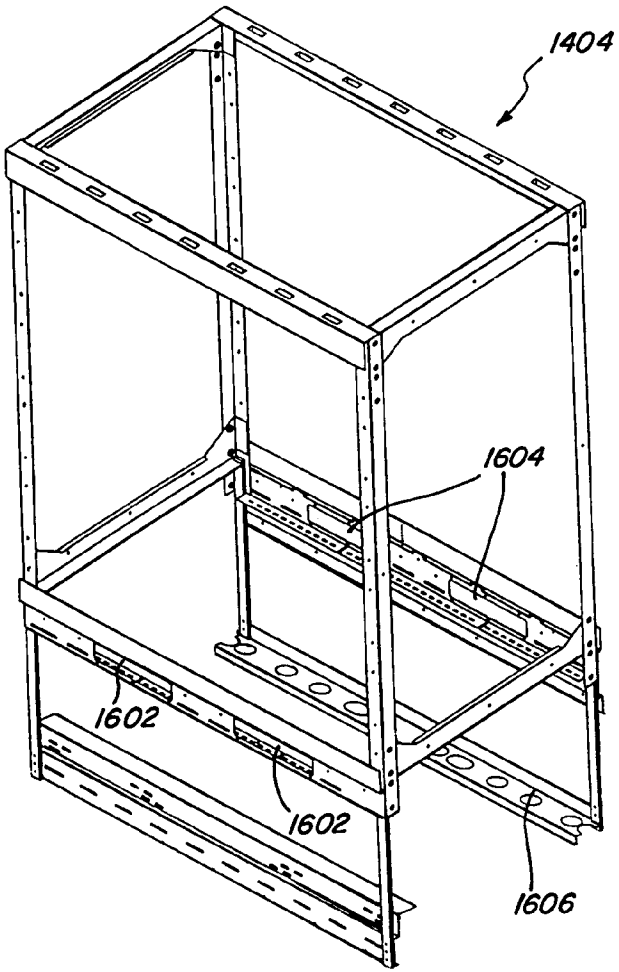
FIG. 16 illustrates an example of a single display frame module which may be composed of metal, wood, plastic and any other type of material or a plurality of materials or composite materials according to an embodiment of the invention.

FIG. 16 illustrates an example of a single display frame module 1404 which may be composed of metal, wood, plastic and any other type of material or a plurality of materials or composite materials according to various implementations of the invention. The display frame module 1404 may be designed with openings 1602 and 1604 which permit use of a forklift to lift the frame module 1404 or combination of modules 1400 or 1500 during assembly of the display module 100. For example, the prongs of a forklift may fit through openings 1602 and 1604 to lift one or more modules. The lower frame of the display module 1404 may also include one or more openings 1606 through which electrical conduit for lighting and other purposes may be passed.

Figure 17:
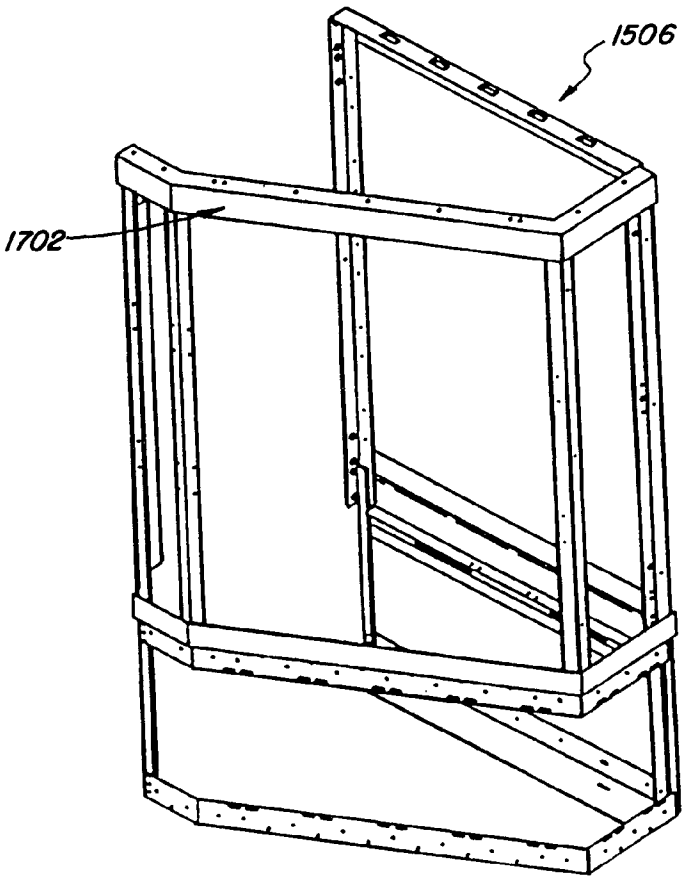
FIG. 17 illustrates an upper end-module section as shown in FIG. 15 according to one embodiment of the invention.

FIG. 17 illustrates an upper end-module section 1506 as shown in FIG. 15 according to one embodiment of the invention. The upper end-module section 1506 has a diagonal surface 1702 corresponding to the curved edge of the corresponding lower cabinet section 108.

The various modules illustrated in FIGS. 14 through 17 may be arranged in a number of ways depending on the retail location, the length of display area available, and how the display system 100 is to be oriented. While interchangeable modules 1404, 1406, 1408, 1502, and 1504 may be used along the middle portions of the upper structure 112, the slanted or curved end modules (e.g., 1506) may need to be rearranged depending on the orientation or desired configuration of the display system 100.

Figure 19:
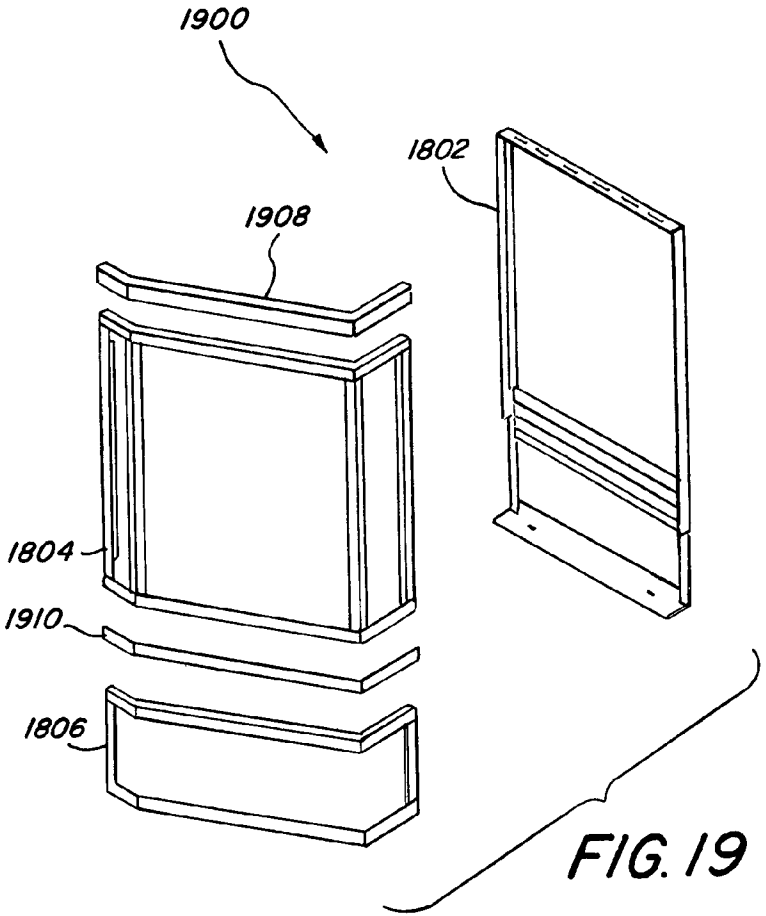
FIGS. 18-19 illustrate the frames for end-sections and the interchangeability of components according to one embodiment of the invention.
Figure 18:
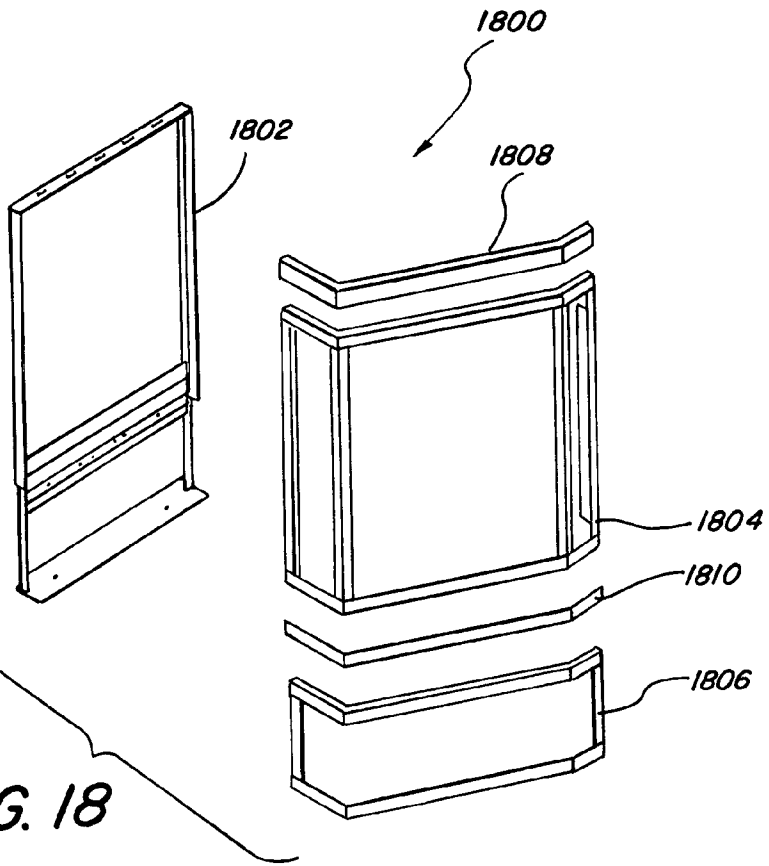

FIGS. 18 and 19 illustrate how left side and right side end modules may be constructed using interchangeable parts according to one embodiment of the invention.

FIG. 18 illustrates a left side setup 1800 for an end-section display frame constructed using a back frame 1802, a front upper frame 1804, and a front lower frame 1806. Additionally, retaining channel 1808 and 1810 serve to secure signage or advertising panels to the front of the display frame 1800.

FIG. 19 illustrates a right side frame 1900 similar to frame 1506 (FIG. 17). The interchangeability of this end-section display frame is illustrated here. The same back frame 1802 may be used as in the left side frame 1800. By rotating front frames 1804 and 1806 one hundred eighty degrees, the same frames as those used in the left side frame (FIG. 18) may be used for the right side display frame 1900. The only different parts that may be needed to construct the right-handed display frame 1900 are retaining channels 1908 and 1910.

Figure 20:
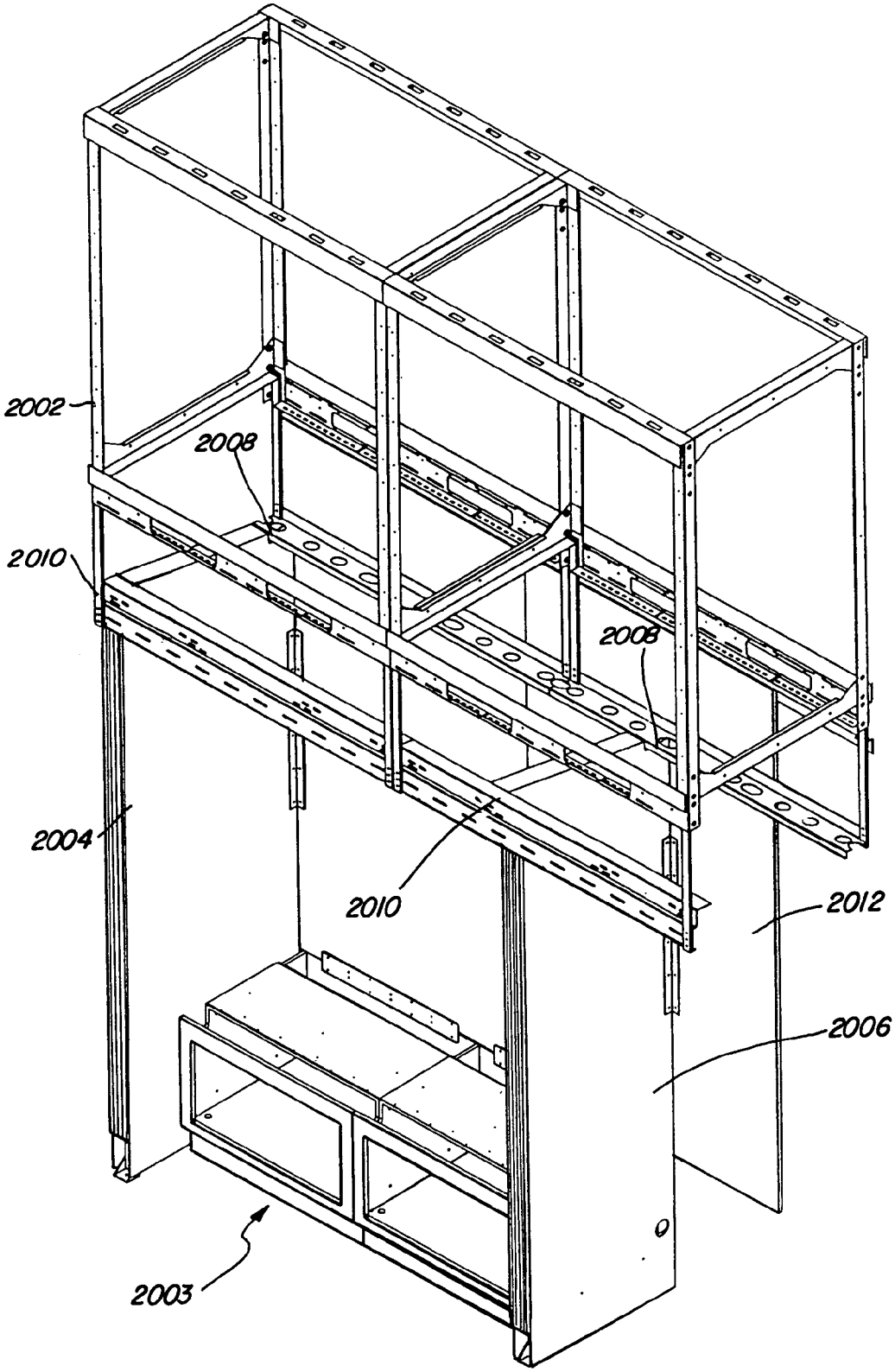
FIG. 20 illustrates how a plurality of upper display frames may be mounted on a lower display section according to one embodiment of the invention.

FIG. 20 illustrates how a plurality of upper display frames 2002 may be mounted on a lower display section 2003 according to one embodiment of the invention. The side walls 2004, 2006 include rear notches 2008 (e.g., 812, 814 in FIG. 1) and front points 2010 on which the upper display frames 2002 may be supported and fastened. In one embodiment of the invention, the upper display frames 2002 may also be fastened to the back panel walls 2012.

Figure 21:
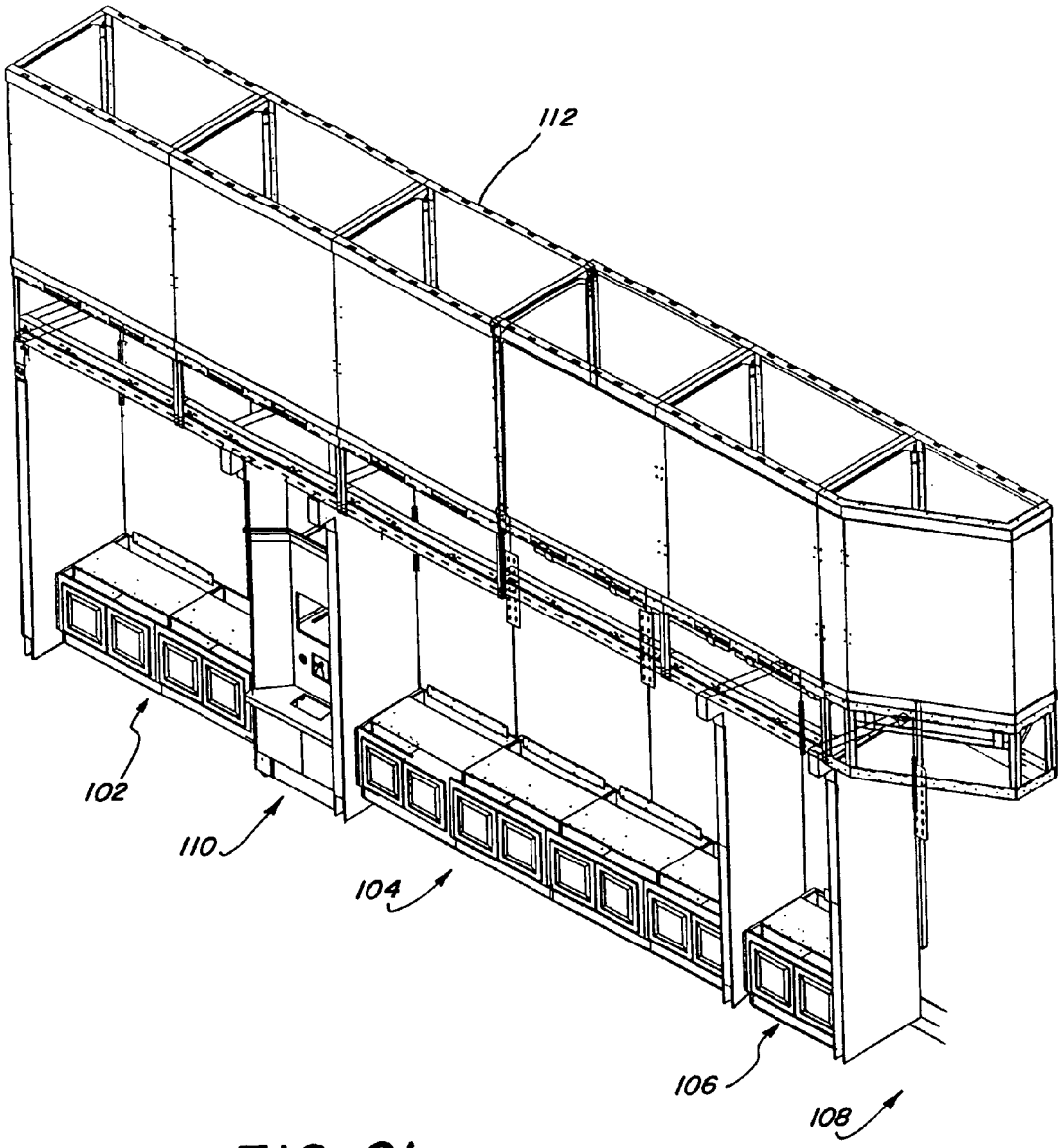
FIG. 21 illustrates how lower display modules may be arranged and upper display modules may be mounted on the lower display modules according to one embodiment of the invention.

FIG. 21 illustrates how lower display modules 102-110 may be arranged and upper display modules 112 may be mounted on the lower display modules 102-110 according to one embodiment of the invention. In this illustration, the upper display frames 1400 (FIG. 14) and 1500 (FIG. 15) have been mounted and secured to the lower display modules 102-110.

Figure 22:
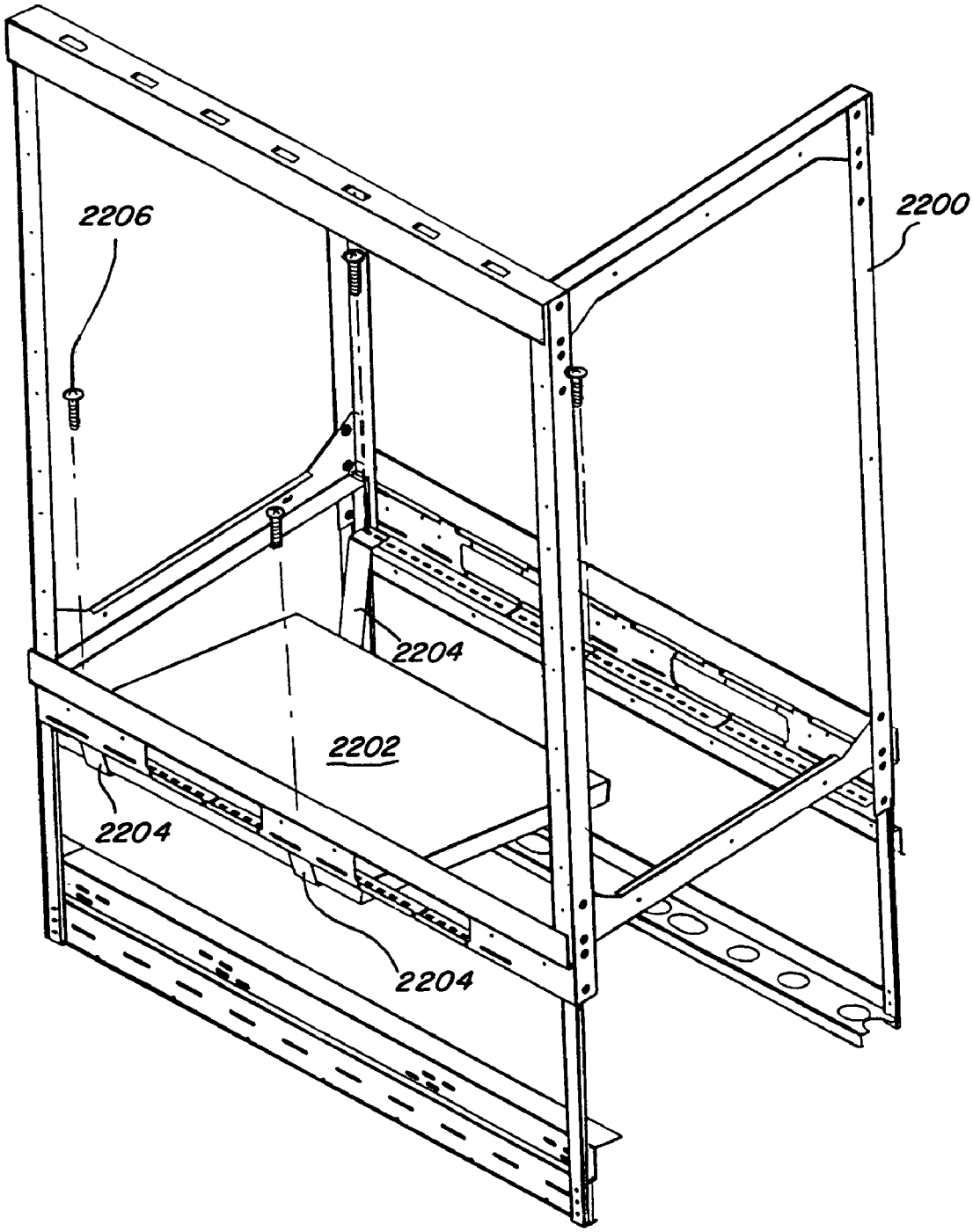
FIG. 22 illustrates an upper display frame with a light-supporting surface which is attached to the frame by use of brackets and a plurality of fasteners according to one embodiment of the invention.

FIG. 22 illustrates an upper display frame 2200 with a light-supporting surface 2202 which is attached to the frame by brackets 2204 and a plurality of fasteners 2206 according to one embodiment of the invention. The light-supporting fixture 2202 serves to support one or more lights on either the upper surface or lower surface of the fixture 2202.

Figure 23:
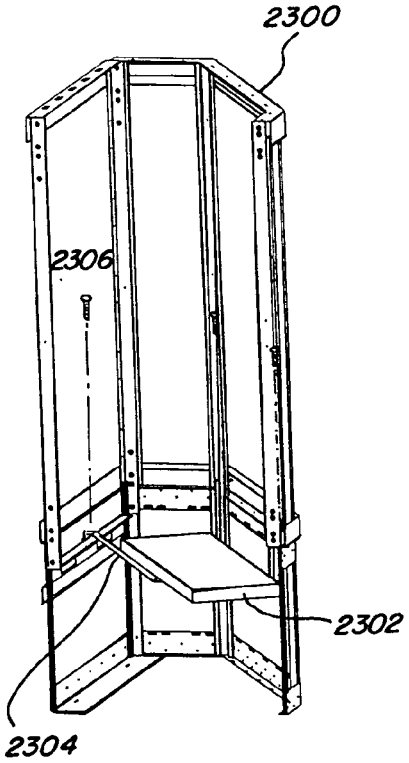
FIG. 23 illustrates an end section of an upper display frame on which a light support fixture may be fastened according to one embodiment of the invention.

FIG. 23 illustrates an end section 2300 of an upper display frame on which a light support fixture 2302 may be fastened according to one embodiment of the invention. Like the support fixture 2202 in FIG. 22, support fixture 2302 also serves to support lights on the upper surface and/or lower surface of the fixture 2302. A plurality of brackets 2304 and fasteners 2306 may couple the fixture 2302 to the side frame 2300. According to one implementation of the invention, the same support fixture 2302 may be used in both the end section and other upper display frames. Such interchangeability of parts reduces the cost of manufacturing and simplifies installation.

Figure 24:
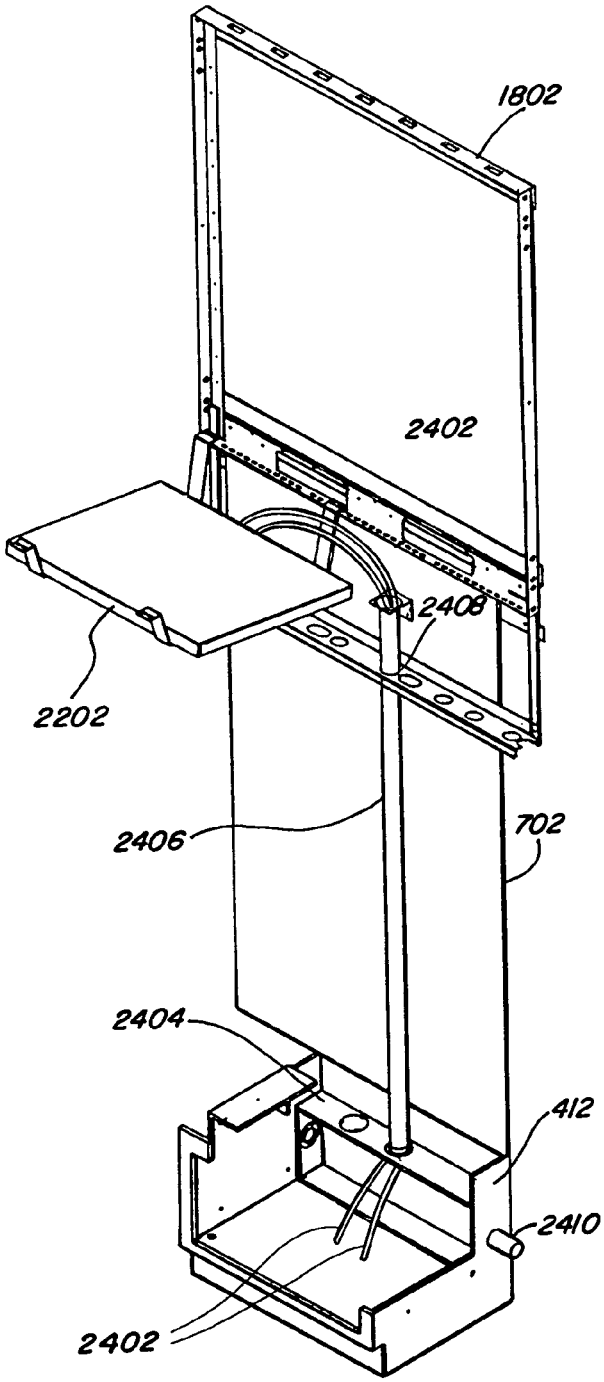
FIG. 24 illustrates how electrical wires may be routed throughout various portions of the lower and upper display assemblies according to one embodiment of the invention.

FIG. 24 illustrates how electrical wires 2402 may be routed throughout various portions of the lower and upper display assemblies according to one embodiment of the invention. Electrical box 2404 may be housed within the lower cabinet 412. Conduit 2406 may carry electrical wires 2402 from the electrical box 2404 to the upper display area. In the upper display area, the wires 2402 may be coupled to the lights on the upper or lower surfaces of the light-supporting fixture 2202. Electrical box 2404 may also include conduit 2410 through the side of box 412 to carry electricity to and/or from adjacent cabinet sections. The lower portion of frame 1802 also includes openings 2408 through which a conduit 2406 may be passed.

Figure 25:
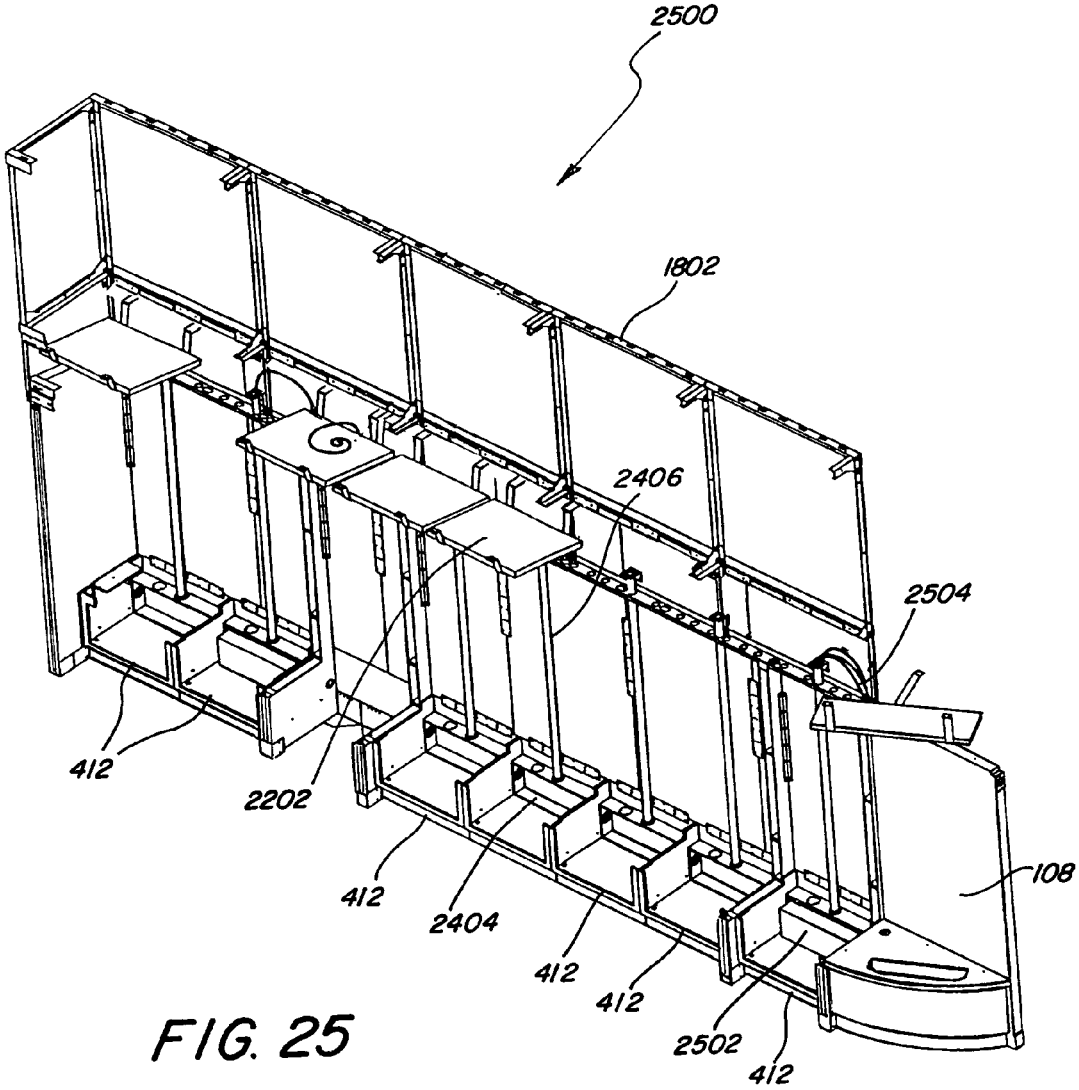
FIG. 25 illustrates how electrical wiring may be run throughout a display system according to one embodiment of the invention.

FIG. 25 illustrates how electrical wiring may be ran throughout a complete display module 2500 according to one embodiment of the invention. The plurality of lower cabinets 412 may include a plurality of electrical boxes 2404 with electrical conduit 2406 running along the rear portion of the display module 2500 to light-supporting fixtures 2202. The electrical boxes 2404 may also include an electrical ballast 2502 to which the electrical wires connect. While this figure illustrates one way of routing electrical wires throughout the display module 2500, other routing schemes are also possible without departing from the invention.

Figure 26:
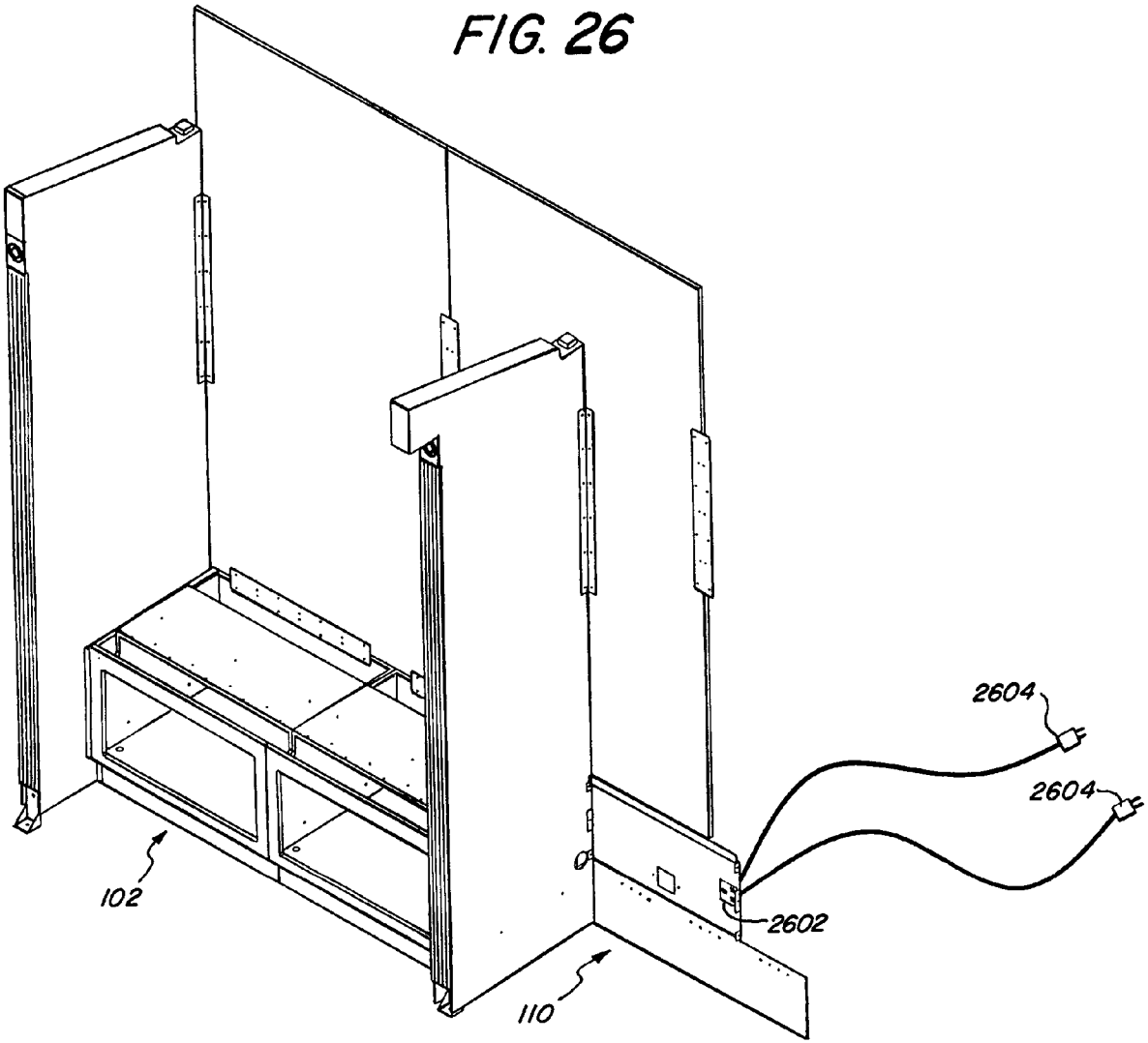
FIG. 26 illustrates how a section of the display system may include an electrical outlet plug which may be connected via wires to another electrical outlet according to one embodiment of the invention.

FIG. 26 illustrates how cabinet section 110 (FIG. 1) may include an electrical outlet plug 2602 which may be connected via wires 2604 to another electrical outlet according to one embodiment of the invention. The electrical plug 2602 may provide electrical power to a kiosk, lights, or other devices that may be inserted in section 110.

Figure 27:
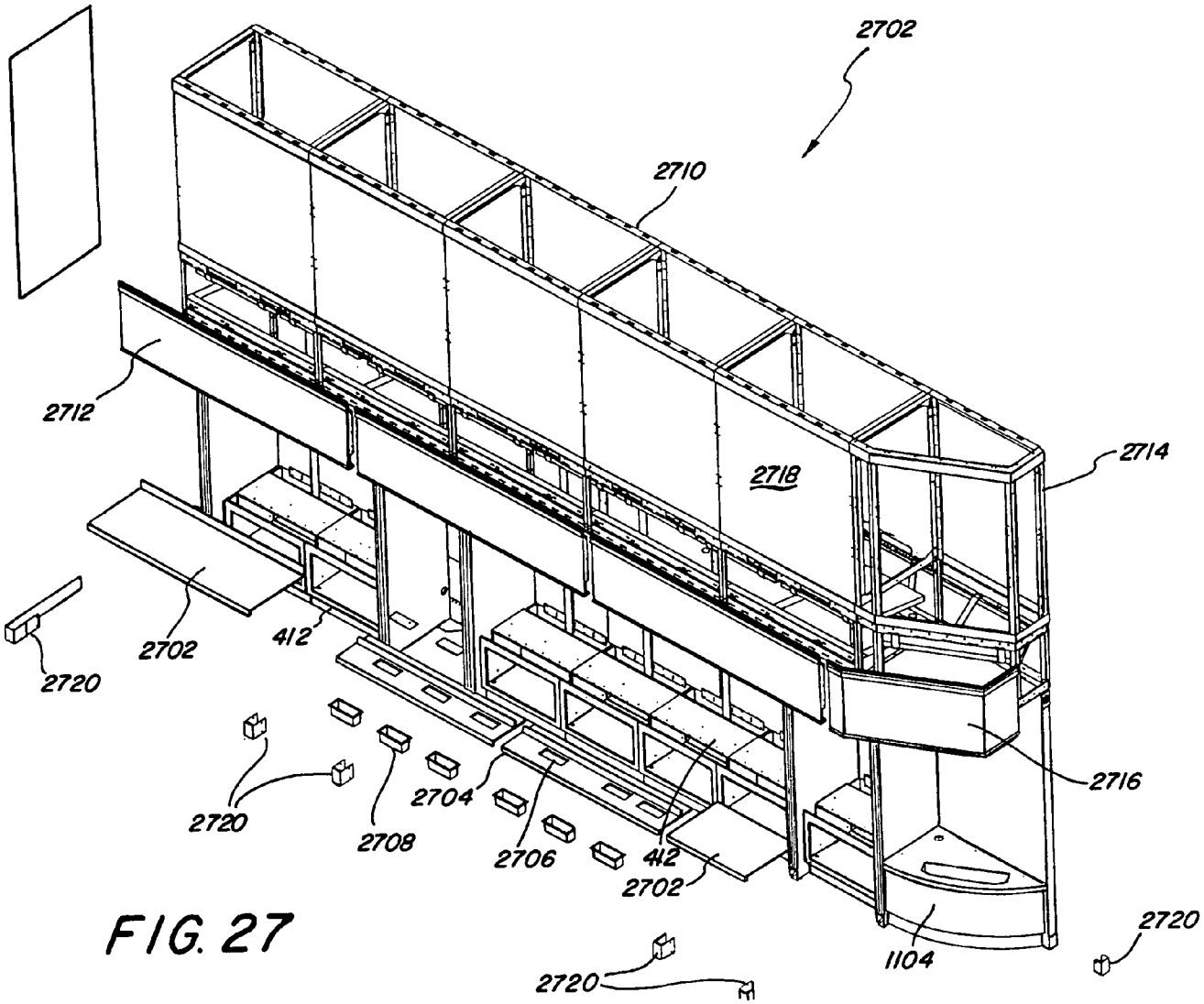
FIG. 27 illustrates an embodiment of the display system to which a plurality of countertops, signage, and headers may be mounted according to one embodiment of the invention.

FIG. 27 illustrates an embodiment of the display system 2700 to which a plurality of countertops, signage, and headers may be mounted according to one embodiment of the invention. Some countertops may be flat, such as 2702, while other countertops, such as 2704, may include an opening 2706 to hold a countertop brochure holder 2708. Such countertops may be mounted on top of the lower cabinets 412. The lower portions of the upper display racks 2710 may serve to hold in-line brand headers 2712 through either clip-on, pressure or other types of fastening means. The end display unit 2714 may include a special banner header 2716 that conforms to the shape of the frame 2714. The upper portion of the display frames 2710 may hold various display information on panels 2718.

A plurality of end covers 2720 may be slideably mounted to the lower front edge of the walls 402-410, 802, 1303 to cover-up the lower brackets 806 securing the walls to the floor.

Figure 28:
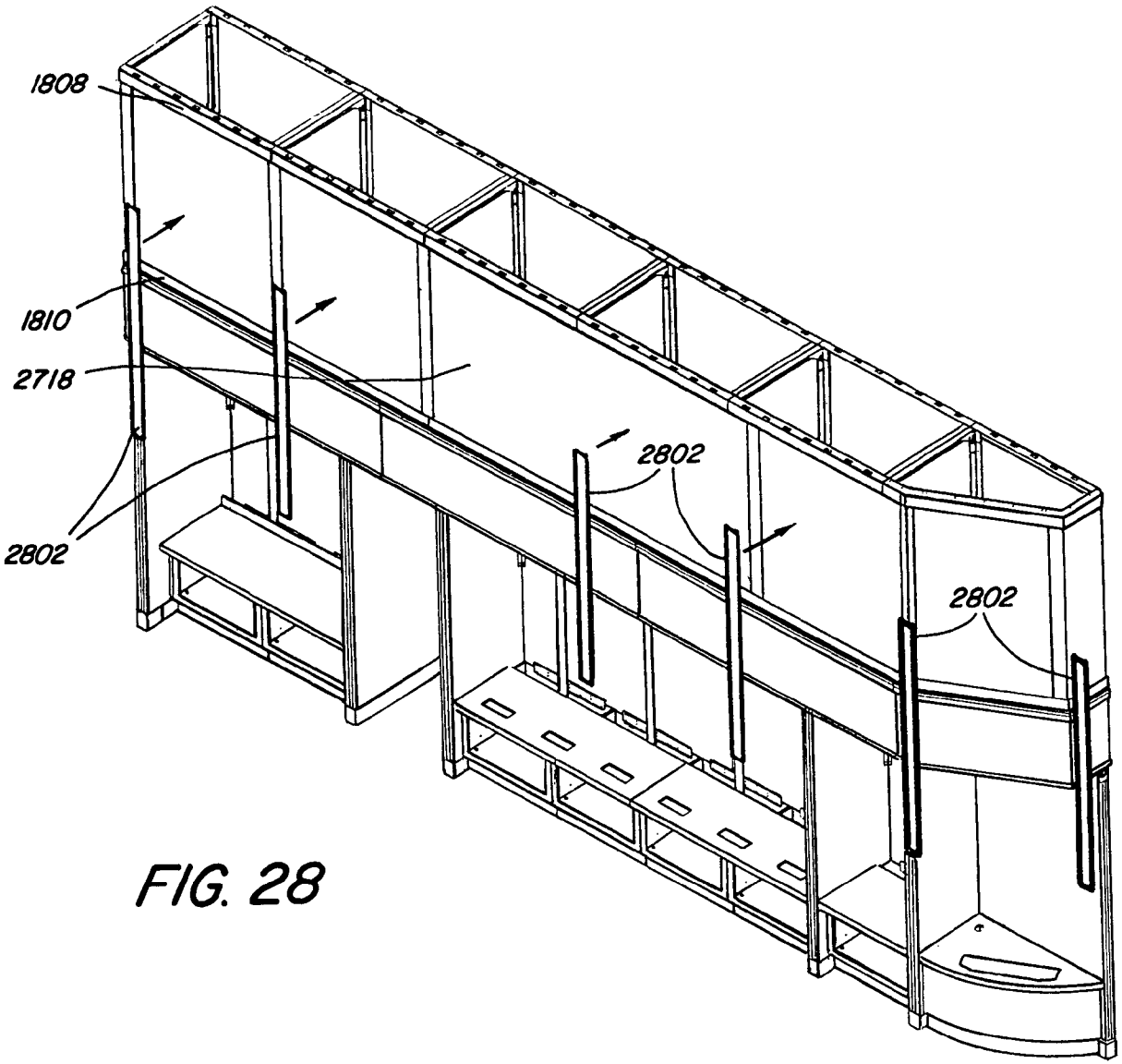
FIG. 28 illustrates how graphic display panels may be mounted on the upper display frames according to one embodiment of the invention.

FIG. 28 illustrates how graphic display panels 2718 may be mounted on the upper display frames 2710 according to one embodiment of the invention. Graphic display panel holders 1808 and 1810 are mounted along the frame edges to support and secure the display panels 2718 while seam covers 2802 are used to cover the gaps between the display panels 2718.

Figure 29:
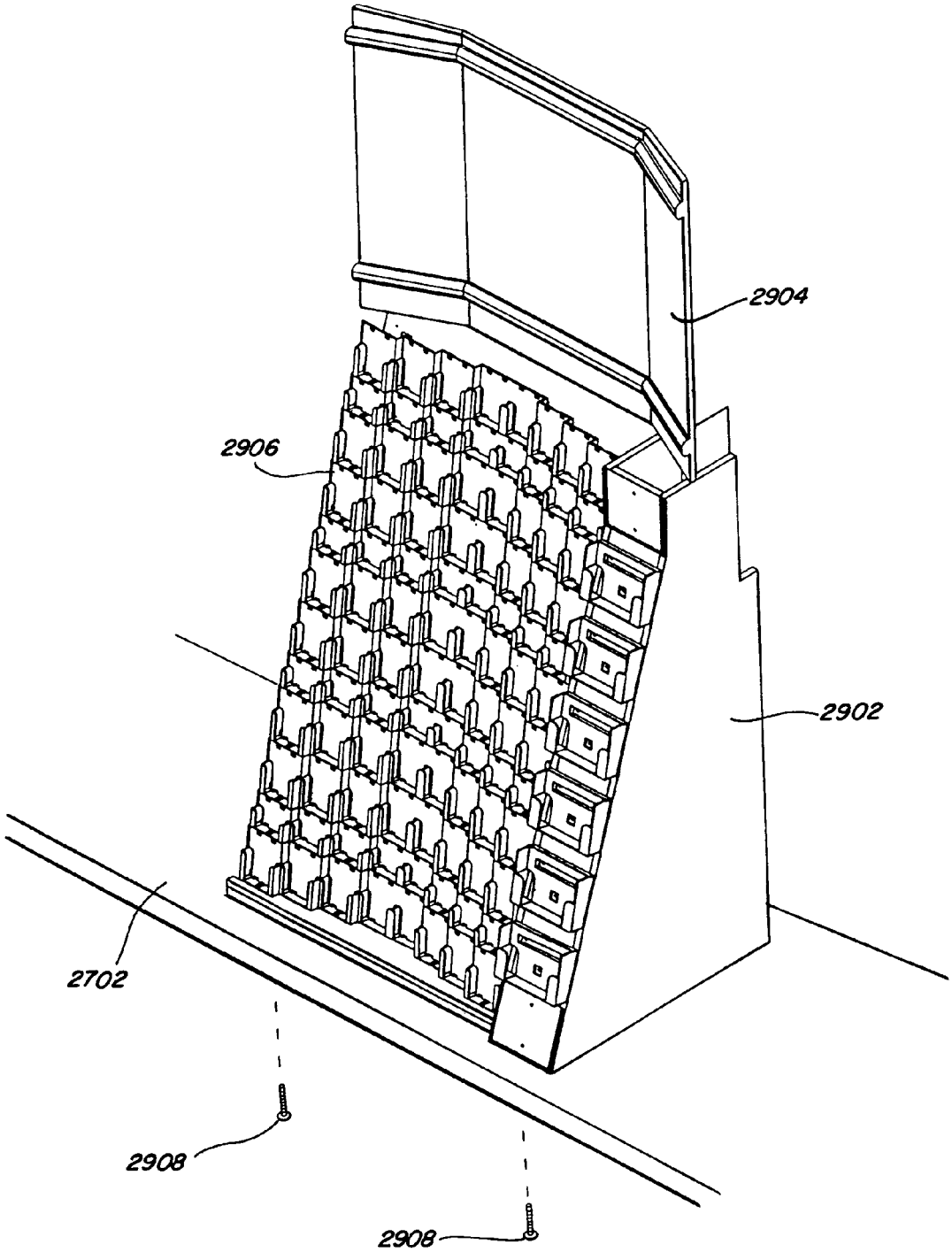
FIG. 29 illustrates a color display pallet that may be mounted on top of a counter area according to one embodiment of the invention.

FIG. 29 illustrates a color display pallet 2902 that may be mounted on top of a counter area 2702 according to one embodiment of the invention. The color display pallet 2906 may include a plurality of color sample holders to hold color samples and brochures. The color display pallet 2902 may also have an upper display area 2904 on which information may be displayed. A plurality of fasteners 2908 may be used to secure the color display pallet 2902 to the counter surface 2702. The upper display area 2904 may also be attached to the counter display pallet 2902 by fasteners and/or brackets.

Figure 30:
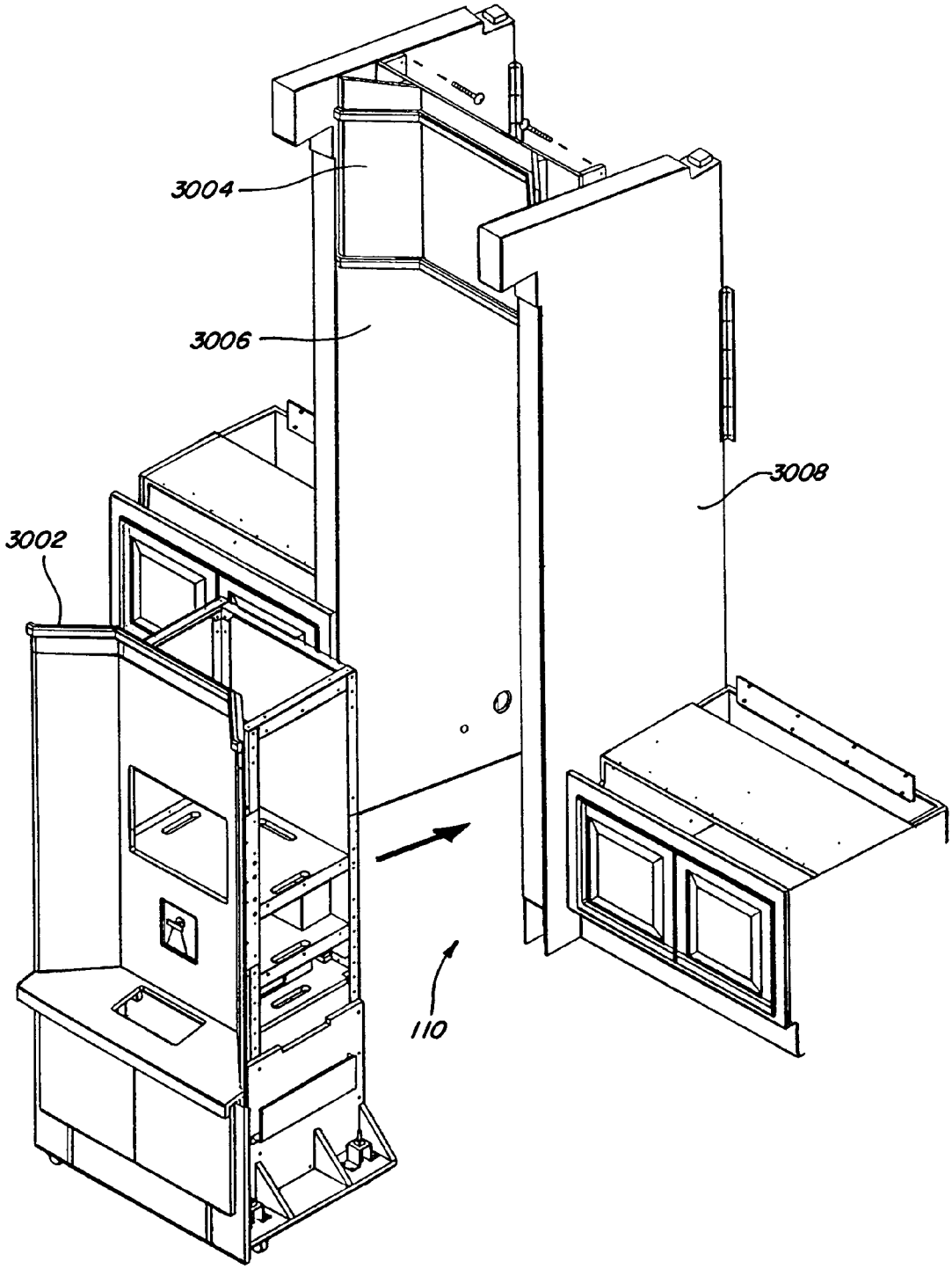
FIG. 30 illustrates a paint selection kiosk and how it may be inserted into a display region of the color display system according to one embodiment of the invention.

FIG. 30 illustrates a paint selection kiosk 3002 and how it may be inserted into a display region 110 (FIG. 1) between walls 3006 and 3008 according to one embodiment of the invention. The upper portion of the display region 110 may also include a panel 3004 to cover up any space between the top of the display kiosk 3002 and the display region 110.

Figure 31:
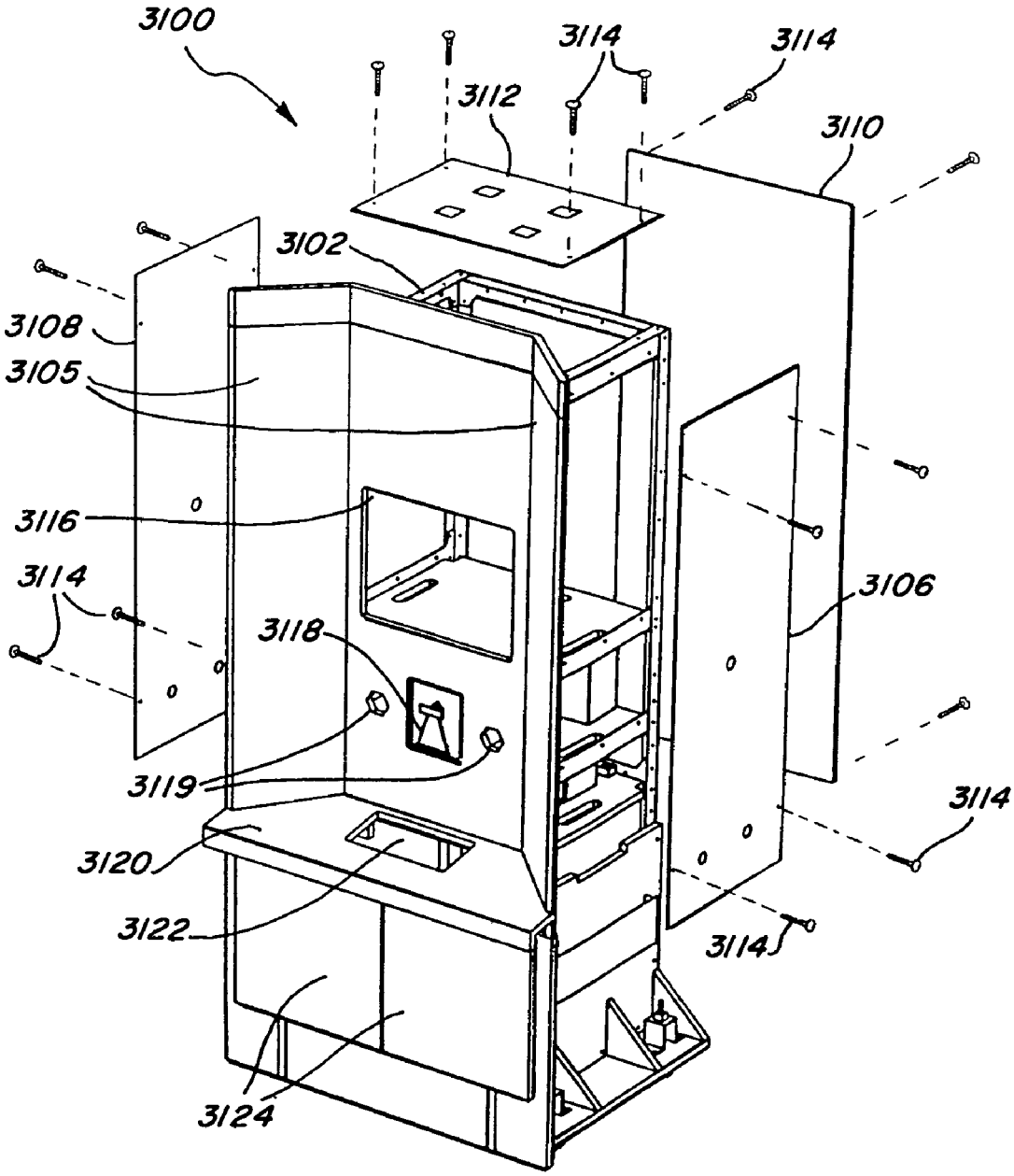
FIG. 31 illustrates a front side perspective view of the paint selection kiosk cabinet according to one embodiment of the invention.
Figure 32:
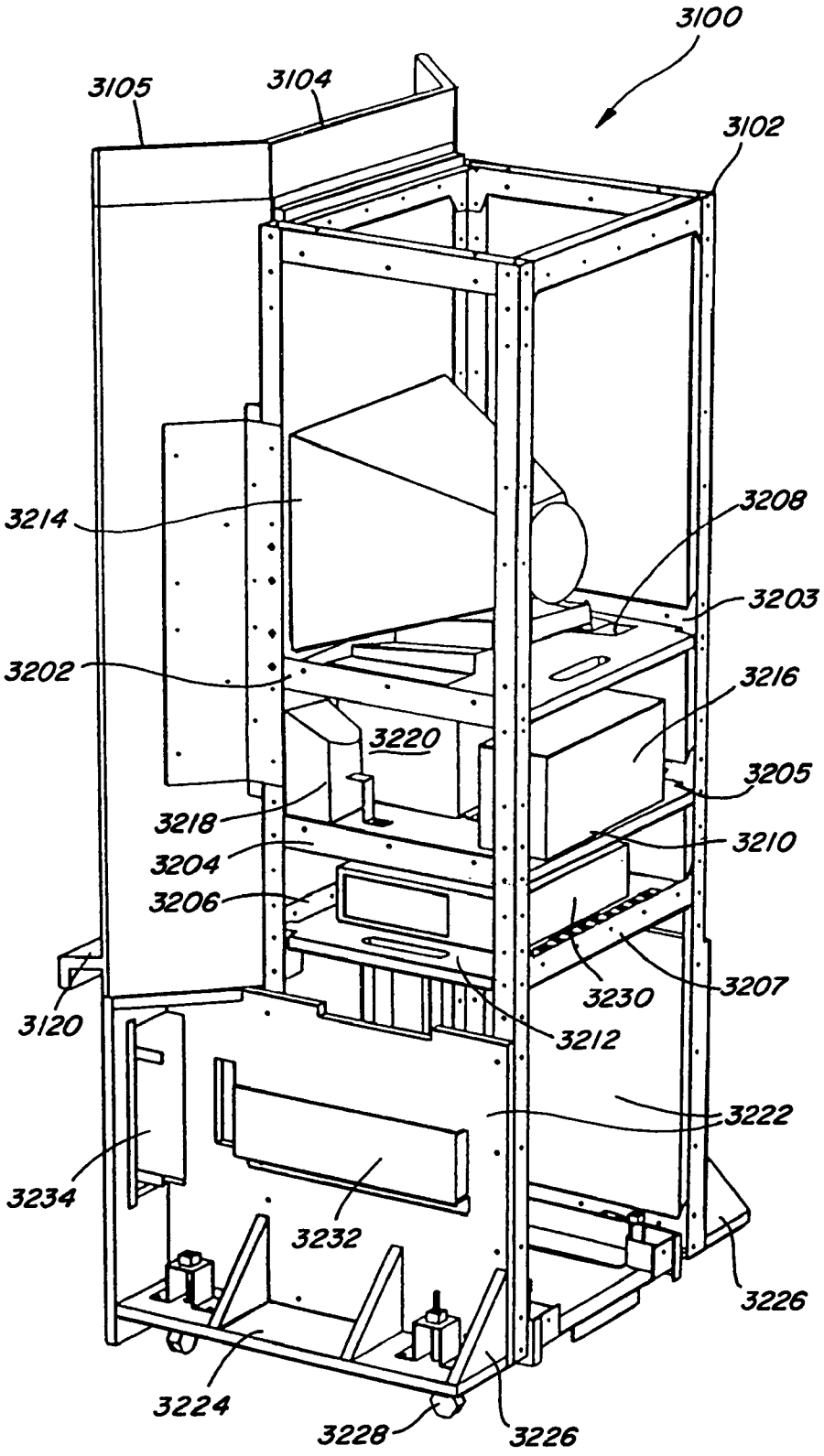
FIG. 32 illustrates a back-side view of the paint selection kiosk cabinet illustrated in FIG. 31 according to one embodiment of the invention.
Figure 33:
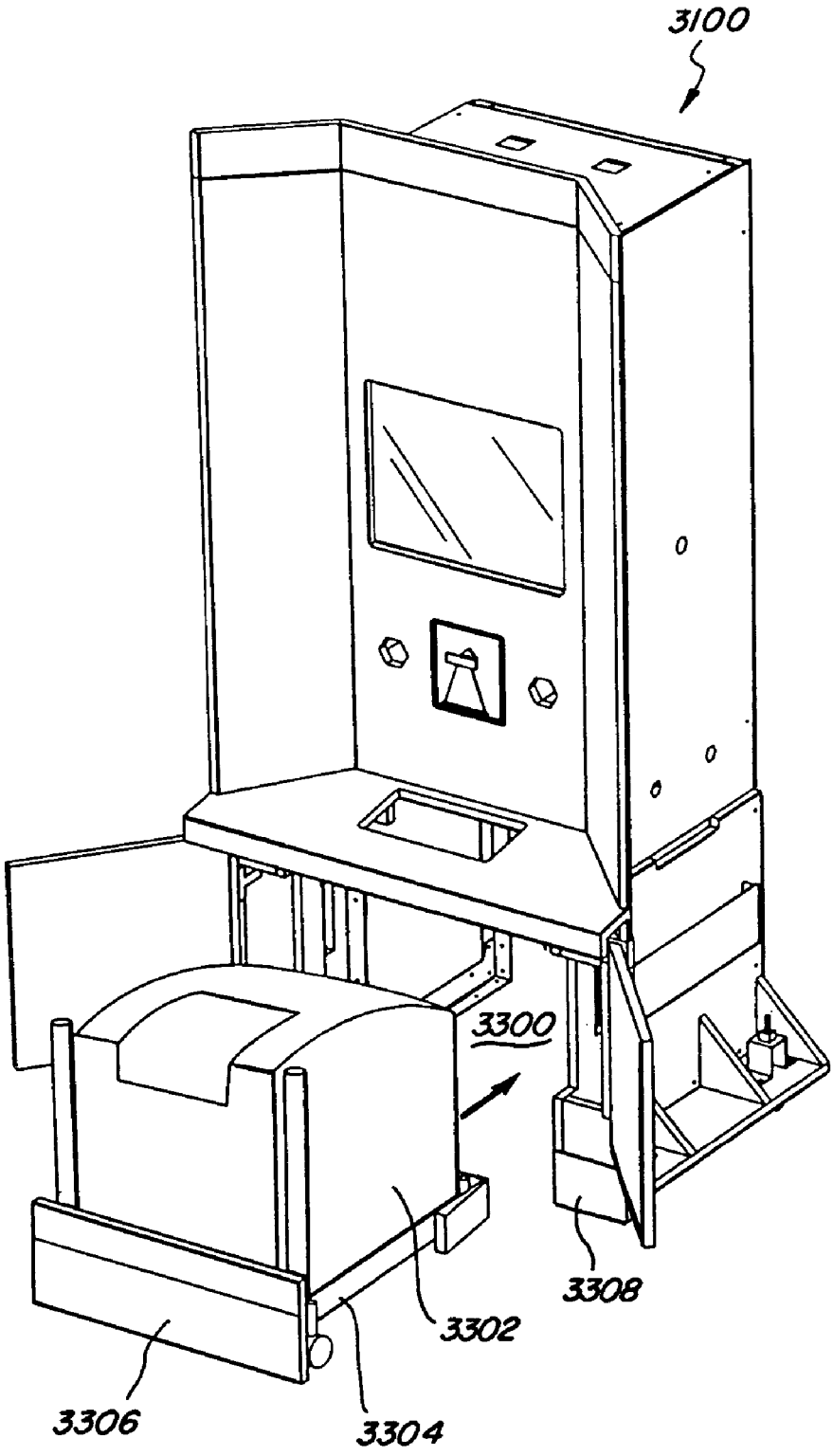
FIG. 33 illustrates a front perspective view of the paint selection kiosk illustrated in FIG. 31 showing how a printer may be integrated as part of the kiosk according to one embodiment of the invention.

FIGS. 31-33 illustrate the various components that make up the paint selection kiosk according to one embodiment of the invention.

FIG. 31 illustrates a front-side perspective view of the paint selection kiosk cabinet 3100 according to one embodiment of the invention. The paint selection and coordination kiosk 3100 includes a cabinet frame 3102, which may be made from a metal, wood, and/or other materials, onto which a front panel 3104, side panels 3106 and 3108, a back panel 3110 and a pop cover 3112 are attached with fasteners 3114. According to one embodiment of the invention, slanted portions 3105 may be coupled along the vertical edges of the front panel 3104. The front panel 3104 may also include a first opening 3116 to permit viewing of a display screen that may be mounted within the cabinet 3100. Furthermore, the front panel 3104 may include a second opening to hold a color-sensing device 3118. In one embodiment of the invention, the front panel 3104 also includes one or more openings 3119 behind which one or more speakers may be mounted.

According to one embodiment of the invention, the front of the paint selection and coordination kiosk 3100 may also include a horizontal or semi-horizontal surface 3120 with an opening 3122 from which printer paper may be collected. Below the horizontal surface 3120 a pair of vertically swinging doors 3124 serve to enclose a compartment area. The doors 3124 may be hung from the cabinet frame 3102.

FIG. 32 illustrates a back-side view of the paint selection kiosk cabinet 3100 illustrated in FIG. 31 according to one embodiment of the invention. One or more rails 3202-3207 may serve to support one or more horizontal surfaces 3208, 3210, and 3212. For example, a first horizontal surface 3208 may be supported by and/or coupled to rails 3202 and 3203. A display device (e.g. monitor and/or screen) 3214 may be mounted on the first horizontal surface 3208 such that the display of the device 3214 is visible through opening 3116 in the front panel 3104 of the kiosk 3100.

A second horizontal supporting surface 3210 may be supported by, or coupled to, horizontal rails 4204 and 3205. Horizontal surface 3210 may serve to support one or more devices. For example, in one implementation, a power supply 3216, speakers 3218 and a color-sensing device or spectrophotometer 3220 may be mounted to and/or attached to horizontal surface 3210. Various different brackets or fasteners may secure the speakers 3218, color-sensing device 3220 and power supply device 3216 to the cabinet according to one embodiment of the invention.

A third horizontal surface 3212 may be mounted on and/or secured to horizontal rails 3206 and 3207 of the cabinet frame 3102. According to one embodiment of the invention, a processing unit (e.g., computer) 3230 may be mounted within the kiosk 3100 on top of the horizontal surface 3212. The processing unit 3230 may be secured to the horizontal surface 3212.

The kiosk cabinet frame 3102 may also include side panels 3222 fastened to a lower portion of the cabinet frame 3102. Supporting members 3224 may be coupled to the lower side panel 3222 by one or more brackets or perpendicularly supporting members 3226. The supporting members 3224 may support the cabinet 3100 on a plurality of legs or wheels 3228. The supporting legs or wheels 3228 may include a leveling or height adjusting mechanism such as a nut and thread bolt.

According to one embodiment of the invention, a keyboard holder and/or mouse holder 3232 may be mounted on the side panel 3222 on the lower portion of the cabinet frame 3102. A keyboard or mouse stored in the holder 3232 may be accessed through an opening 3234 in the front of the paint selection kiosk 3100. According to one embodiment of the invention, the opening 3234 may be accessed by opening one of the lower doors 3124 of the kiosk 3100.

FIG. 33 illustrates a front perspective view of the kiosk 3100 showing how a printer 3302 may be integrated as part of the kiosk 3100 according to one embodiment of the invention. The printer 3302 may be mounted on a rolling platform or cart 3304 so that it may be easily moved in and/or out of the kiosk compartment 3300. The printer platform 3304 may also include a trim 3306 along the lower front part of the printer platform or dolly 3304 such that it matches the trim 3308 along the lower edge of the kiosk cabinet 3100. The printer 3302 may be communicatively coupled to the computer or processing unit 3230 in such a way that permits removal of the printer 3302. In one implementation of the invention, the printer 3302 may be coupled to the computer by cables long enough to permit removing the printer 3302 and cart 3304 from the compartment 3300 without first unplugging the cables.

The kiosk illustrated in FIGS. 31-33 may be configured to aid a person in selecting a starting color (e.g., starting or desired paint color) as well as provide complementary, harmonious, and/or aesthetically pleasing paint colors. In one implementation, such kiosk may serve as a paint color selector and coordinator for paint projects such as a painting interiors (e.g., rooms, etc.) or the house exteriors.

While certain exemplary embodiments have been described and shown in the accompanying drawings, it is to be understood that such embodiments are merely illustrative of and not restrictive on the broad invention, and that this invention not be limited to the specific constructions and arrangements shown and described, since various other modifications are possible. Those skilled, in the art will appreciate that various adaptations and modifications of the just described preferred embodiment can be configured without departing from the scope and spirit of the invention: Therefore, it is to be understood that, within the scope of the appended claims, the invention may be practiced other than as specifically described herein.

What is claimed is:

1. A display comprising:

a plurality of interchangeable sidewalls each having a back edge;

a plurality of cabinets, each interchangeable with the other, each having a rectangular cross-section and first and second side surfaces;

a plurality of interchangeable rectangular back panels;

said sidewalls, cabinets, and back panels being configured into a plurality of modules, said modules comprising:

a first module defining a first display area and comprising:

(a) a first and second of said interchangeable sidewalls, each positioned upright and parallel to the other, each of said first and second sidewalls having a horizontal lower edge resting on a floor surface and respective upper horizontal edges lying in a common plane; and (b) a first and second of said interchangeable cabinets disposed adjacent one another, each having a bottom surface resting on said floor surface, the first side surface of the first cabinet being attached to an inner side surface of said first panel, the second side surface of said first cabinet being attached to the first side surface of said second cabinet, the second side surface of said second cabinet being attached to an inner side surface of said second sidewall, said cabinets serving as a base of support for said sidewalls;

a second display module defining a second display area and comprising:

(a) a third and fourth of said interchangeable sidewalls, each positioned upright and parallel to the other, each of said third and fourth sidewalls having a horizontal lower edge resting on the floor surface and respective upper horizontal edges lying in said common plane; and (b) a second plurality of said first plurality of interchangeable cabinets attached together in a row, one of said second plurality of interchangeable cabinets at one end of said row having its first side surface attached to a side surface of said third interchangeable side wall, a second of said second plurality of cabinets at an opposite end of said row having its second side surface attached to a side surface of said fourth interchangeable side wall;

a fifth of said sidewalls being positioned upright and parallel to the first, second, third and fourth sidewalls with a sixth of said cabinets having a bottom surface resting on said floor surface adjacent said fifth sidewall, one of the first and second side surfaces of the sixth cabinet being attached to a side surface of said fifth sidewall, the other side surface of said sixth cabinet being attached to a side surface of one of the other sidewalls of said display, thereby defining a third display area;

said plurality of interchangeable back panels being so dimensioned as to be attachable adjacent one another across the back edges of and perpendicular to said first, second, third, fourth and fifth sidewalls so as to close the space between said back edges and so as to space a selected pair of said first, second, third, fourth and fifth side walls apart to define a fourth open display area comprising a rectangular empty space bounded by said floor surface and a selected pair of panels and such that said sidewalls are repositionable with respect to said back panels so as to enable relocating of said fourth open display area between a different selected pair of said sidewalls; and wherein each of said side walls includes a notched region in an upper end thereof and wherein said display further comprises:

an upper display section comprising a frame structure supported by said upright side walls, said frame structure having a lower rear portion thereof fitting into the notched regions in the upper end of each of the side walls, the frame structure including a plurality of interchangeable interconnected box-like frames disposed adjacent one another in a horizontal row; and a plurality of display panels covering the frame structure and positioned entirely above said upright sidewalls.

2. The display of claim 1 further comprising a removable kiosk positioned in said fourth display area.

3. The display of claim 2 wherein the kiosk comprises a paint selection kiosk that includes at least a first opening configured to permit viewing of a display screen and a second opening configured to hold a color-sensing device.

4. The display of claim 3 including a plurality of counter tops supported on the cabinets and at least one color display pallet removably secured to at least one of the counter tops, wherein the color display pallet.

5. A modular display assembly comprising:

a free standing lower display section having three or more interchangeable vertically positioned, spaced apart side walls, each side wall being positioned in parallel with each of the other sidewalls and having a rear edge, a lower end and upper end, each side wall being removably attachable to a floor base and having a notched region in an upper end, each notched region being spaced apart from the next by the distance between their respective sidewalls, and wherein the space between adjacent side walls is sized to receive one or more display modules;

a plurality of interchangeable back panels each lying in a common vertical plane, each vertical sidewall being disposed perpendicularly to said common plane;

the back panels being removably attached to the three or more side walls to enclose respective open ends between the rear edges of the side walls;

a plurality of interchangeable cabinets located in respective spaces between the side walls;

the interchangeable cabinets being removably fastened to at least one of the plurality of interchangeable back panels between adjacent side walls; and an upper display section having a vertical front display surface positioned entirely above said lower display section and having, a frame structure having a lower rear end portion fitted into each of the notches in the vertically positioned side walls and supported by said sidewalls, and a lower front end portion adapted to be fastened to the vertically positioned side walls, the frame stucture being positioned entirely above said lower display section except for said lower rear and front end portions; and a plurality of graphic panels covering the frame structure;

whereby the lower display section may be reconfigured without removing the upper display section by unfastening only the side walls to be moved, leaving all other side walls positioned to continue supporting the upper display section during the reconfiguration, the side walls being moveable to create a new display space allocation.

6. A method of manufacturing a modular display assembly comprising the steps of;

assembling a lower display section by:

(a) removably fastening three or more vertically-positioned interchangeable side walls to a floor base, each side wall being positioned parallel to each other side wall and having a lower end and upper end and a notched region in the upper end;

(b) removably fastening a plurality of interchangeable back panels in a common plane, said common plane being perpendicular to each of the side walls so as to enclose an open end between rear edges of the sidewalls; and (c) removably fastening a plurality of interchangeable cabinets to the back panels in a space between adjacent side walls;

and assembling an upper display section by:

(a) coupling a plurality of interchangeable display frames together in a horizontal row;

(b) coupling an end-section display frame to the interchangeable display frames, the end-section display frame and interchangeable display frames adapted to fit on the side walls of the lower display section and into the notched regions in the upper end of the side walls; and lifting the upper display section above the lower display section; and lowering the upper display section onto the lower display section such that a rectangular front surface of the upper display section is positioned entirely above the lower display section and such that a rear lower most edge of the upper display section engages and is supported by each of the notched regions in the upper end of the sidewalls.

7. The display of claim 1 wherein said display comprises a display of paint color samples including a color display pallet located between a pair of said side walls and comprising a plurality of color sample holders shaped and dimensioned to hold color samples.

8. The modular display assembly of claim 5 wherein said display assembly comprises a display of paint color samples including a color display pallet located between a pair of said side walls and comprising a plurality of color sample holders shaped and dimensioned to hold color samples.

9. The modular display assembly of claim 5 wherein the frame structure of the upper display section includes a plurality of interchangeable box-shaped frames each disposed adjacent one another in a horizontal row and coupled together.

10. The modular display assembly of claim 9 wherein the upper display section further includes at least one light support fixture attached to the light support surfaces, the at least one light support fixture mounted so that light from the fixture shines down on the lower display section.

11. The modular display assembly of claim 9 further comprising an end-section frame coupled to one of the interchangeable frames, the end-section frame structured so that it may be coupled at either end of the upper display assembly.

12. The modular display assembly of claim 5 further comprising:

a paint selection kiosk positioned in a space between two adjacent side walls, the kiosk having a first opening for a video screen and a second opening for a color-sensing device.

13. The method of manufacturing a modular display assembly of claim 6 further comprising:

assembling the upper display section by:

mounting a light support on the display frames of the upper display section.

14. The method of manufacturing a modular display assembly of claim 6 further comprising: positioning a paint selection kiosk between two adjacent side walls, the kiosk having a first opening for a screen and a second opening for a color-sensing device.

15. The method of manufacturing a modular display assembly of claim 6 wherein coupling the end-section display frame further includes assembling interchangeable components in one way to create a first end-section and assembling the interchangeable components in another way to create a second end-section.

16. The modular display assembly of claim 5 wherein each side wall of the lower display section also has a location point displaced from the notch in the upper end of the side wall.

17. The modular display assembly of claim 5 including at least one rounded end section attached to one of the side walls.

18. The modular display assembly of claim 17 including at least one curved cabinet received within the rounded end section, the curved cabinet including at least one opening in an upper surface to receive a holder.

19. The modular display assembly of claim 5 including at least one bracket coupled to each cabinet to secure each cabinet to a floor.

20. The modular display assembly of claim 5 including a plurality of angle brackets coupling the back panels to the side walls and a plurality of flat braces coupling the back panels to the cabinets.

21. The modular display assembly of claim 5 wherein the frame structure comprises a plurality of frame modules that are mounted to the upper ends of the side walls.

22. The modular display assembly of claim 21 wherein each frame module supports at least one light-supporting surface comprising a generally planar surface that extends substantially over an associated display module in the lower display section.

23. The modular display assembly of claim 21 wherein each of the upper ends of the side walls include rear notches and front points, and wherein the frame modules are secured to the side walls with a plurality of fasteners installed at the rear notches and the front points.

24. The modular display assembly of claim 21 wherein the lower display section includes at least one open area and a removable kiosk positioned in said area.

25. The modular display assembly of claim 24 wherein the kiosk comprises a paint selection kiosk that includes at least a first opening configured to permit viewing of a display screen and a second opening configured to hold a color-sensing device.

26. The modular display assembly of claim 25 including a plurality of counter tops supported on the cabinets and at least one color display pallet removably secured to at least one of the counter tops, wherein the color display pallet includes a plurality of color sample holders.

27. The modular display assembly of claim 21 wherein the upper display section includes an additional display section positioned vertically between the plurality of display panels and the upper ends of the side walls.

28. The modular display assembly of claim 27 wherein the additional display section and the display panels each include vertically extending planar surfaces that display information that is related to the display modules in the lower display section.

29. The modular display assembly of claim 5 wherein the plurality of interchangeable back panels are selectively detachable from adjoining side walls and from each other to provide a replacement space to receive a different display module that includes another back panel.

30. The method of 6 further including dimensioning said plurality of interchangeable back panels so as to be attachable adjacent one another across the back edges of the fifth sidewall so as to space a selected pair of said walls apart to define a display area between said selected pair of panels.

31. The method of claim 30 further including the step of repositioning said sidewalls so as to relocate said fourth display area.

* * * * *